US010495314B2

(12) United States Patent
Little et al.

(10) Patent No.: US 10,495,314 B2
(45) Date of Patent: Dec. 3, 2019

(54) FIREPLACE SAFETY BARRIER SYSTEM

(71) Applicant: FPI FIREPLACE PRODUCTS INTERNATIONAL LTD., Delta (CA)

(72) Inventors: Robert Little, Delta (CA); Julian Mills, Delta (CA)

(73) Assignee: FPI Fireplace Products International Ltd., Delta, British Columbia (CA)

( * ) Notice: Subject to any disclaimer, the term of this patent is extended or adjusted under 35 U.S.C. 154(b) by 354 days.

(21) Appl. No.: 15/356,170

(22) Filed: Nov. 18, 2016

(65) Prior Publication Data

US 2017/0159940 A1 Jun. 8, 2017

Related U.S. Application Data

(60) Provisional application No. 62/264,742, filed on Dec. 8, 2015.

(51) Int. Cl.
*F24B 1/189* (2006.01)
*F24B 1/192* (2006.01)

(52) U.S. Cl.
CPC ..... *F24B 1/189* (2013.01); *F24B 1/192* (2013.01)

(58) Field of Classification Search
CPC ..... F24B 1/189; F24B 1/185; F24B 1/192; F24B 1/198; F24B 1/1955
See application file for complete search history.

(56) References Cited

U.S. PATENT DOCUMENTS 4,282,855 A * 8/1981 Perry ..... F24B 1/192 126/521
4,291,670 A 9/1981 Hyatt
4,292,952 A 10/1981 McDonald
4,519,377 A * 5/1985 Taylor ..... F24B 1/192 126/533
2017/0205072 A1 7/2017 Little

OTHER PUBLICATIONS

USPTO; Non-Final Office Action dated Nov. 1, 2018 in U.S. Appl. No. 15/411,426.
USPTO; Notice of Allowance dated Jan. 24, 2019 in U.S. Appl. No. 15/411,426.

* cited by examiner

*Primary Examiner* — Alfred Basichas
(74) *Attorney, Agent, or Firm* — Snell & Wilmer LLP

(57) ABSTRACT

A fireplace system can comprise a first safety barrier and a second safety barrier disposed across a firebox opening and defining an interbarrier space. A fireplace system can also comprise a heat exchanger in fluid communication with the interbarrier space. The interbarrier space and heat exchanger may further be in fluid communication with ambient air. Operation of the fireplace system may produce natural convection through the interbarrier space, resulting in cooling of the safety barrier and the fireplace system.

15 Claims, 20 Drawing Sheets

500

FIREPLACE SAFETY BARRIER SYSTEM

CROSS-REFERENCE TO RELATED APPLICATION

This application claims priority to and benefit of U.S. Provisional Application No. 62/264,742, filed on Dec. 8, 2015 and entitled "FIREPLACE SAFETY BARRIER SYSTEM."

FIELD

The present disclosure relates to fireplace systems. More particularly, the present disclosure relates to a fireplace system comprising a convection-related cooling system for maintaining a safe operating temperature of an outer fireplace safety barrier.

BACKGROUND

Various fireplaces for residential and commercial users have been made available to consumers over the years with increased efforts to provide for more aesthetically pleasing configurations. There is increasing interest in a clean, streamlined fireplace appearance that maximizes visibility of the fire featured within the fireplace while minimizing the visibility of various features of a fireplace that are required for operation and safety.

Operation and safety of a fireplace requires certain functional features such as air inlets and outlets for circulating air around the fireplace to maintain a safe operating temperature. Likewise, safety regulations in many jurisdictions require that fireplace openings be fitted with safety barriers and that the external surfaces of safety barriers and other external surfaces be maintained below a maximum safe temperature during operation. The various functional features required for operation and safety of existing fireplace systems can impede visibility of the fire within an operating fireplace system and can impinge on the clean, uncluttered aesthetic desired by consumers. Moreover, the design and engineering of the various operational features of existing fireplaces frequently involve electromechanical components that add complexity to a fireplace system. Thus, fireplace systems with a streamlined aesthetic appearance and cooling systems having decreased complexity are desirable.

SUMMARY

In accordance with various aspects of the present disclosure and as described in greater detail below, a fireplace safety barrier system and method can provide for cooling of the outer safety barrier of a fireplace opening using a natural convection cooling system. In various aspects, the outer safety barrier of a fireplace system can be maintained below a maximum safe operating temperature without the need for a fan or blower to provide forced convection. In accordance with an exemplary embodiment, a fireplace system comprises a firebox with a firebox opening, a first safety barrier disposed in front of the firebox opening, and a second safety barrier disposed in front of the first safety barrier and defining an interbarrier space between the barriers. The interbarrier space may be in fluid communication with a firebox top heat exchanger and an interbarrier space inlet. In accordance with various aspects, the interbarrier space inlet is configured to draw ambient or room air into the interbarrier space during operation of the firebox system. In accordance with further aspects, the interbarrier space inlet is not located at a location that is remote from the firebox opening. In various embodiments, the interbarrier space inlet may be within the area defined by the firebox opening or immediately adjacent to and/or partially within the plane of a firebox opening surround defining the firebox opening.

In accordance with various embodiments, a fireplace system can comprise a firebox, a firebox opening, a first safety barrier, and a second safety barrier separated from the first safety barrier by an interbarrier offset dimension. The first and second safety barrier can define an interbarrier space. The fireplace system can further comprise an interbarrier space inlet and an interbarrier space outlet in fluid communication with the interbarrier space. The fireplace system can further comprise a firebox top heat exchanger in fluid communication with the interbarrier space. The firebox top heat exchanger can comprise a cowl that defines a first and second interbarrier space outlet. The fireplace system can further comprise an outlet duct operatively connected to the firebox top heat exchanger and in fluid communication with the interbarrier space outlet. In various embodiments, a fireplace system can comprise a third safety barrier disposed between the first safety barrier and the second safety barrier.

In accordance with various embodiments, a method of cooling a fireplace safety barrier is provided. A method of cooling a fireplace safety barrier can comprise transferring thermal energy from a firebox to a first portion of a convection space air volume. Transferring thermal energy to the convection space air volume can produce a decrease in an air density of the first portion of the convection space air volume, producing an increased air buoyancy of the first portion of the convection space air volume relative to a second portion of the convection space air volume in fluid communication with the first portion. The method can further comprise venting the first portion to a first external location, with the venting producing a bulk air flow. The method can further comprise supplying convection inlet air from an air inlet to maintain the bulk air flow and channeling the bulk air flow through an interbarrier space defined by a first safety barrier and a second safety barrier enclosing a firebox opening. The first portion of the convection space air volume may be contained in a firebox top heat exchanger. Bulk air flow may be directed to a first external location. In various embodiments, the bulk air flow is not produced using a fan or a blower. Channeling the bulk air flow through the interbarrier space may maintain a second safety barrier temperature below a maximum temperature. In various embodiments, the air inlet is within an area defined by a perimeter of the firebox opening.

BRIEF DESCRIPTION OF THE DRAWINGS

The exemplary embodiments of the present disclosure will be described in conjunction with the appended drawing figures in which like numerals denote like elements and.

DETAILED DESCRIPTION

Figure 1:
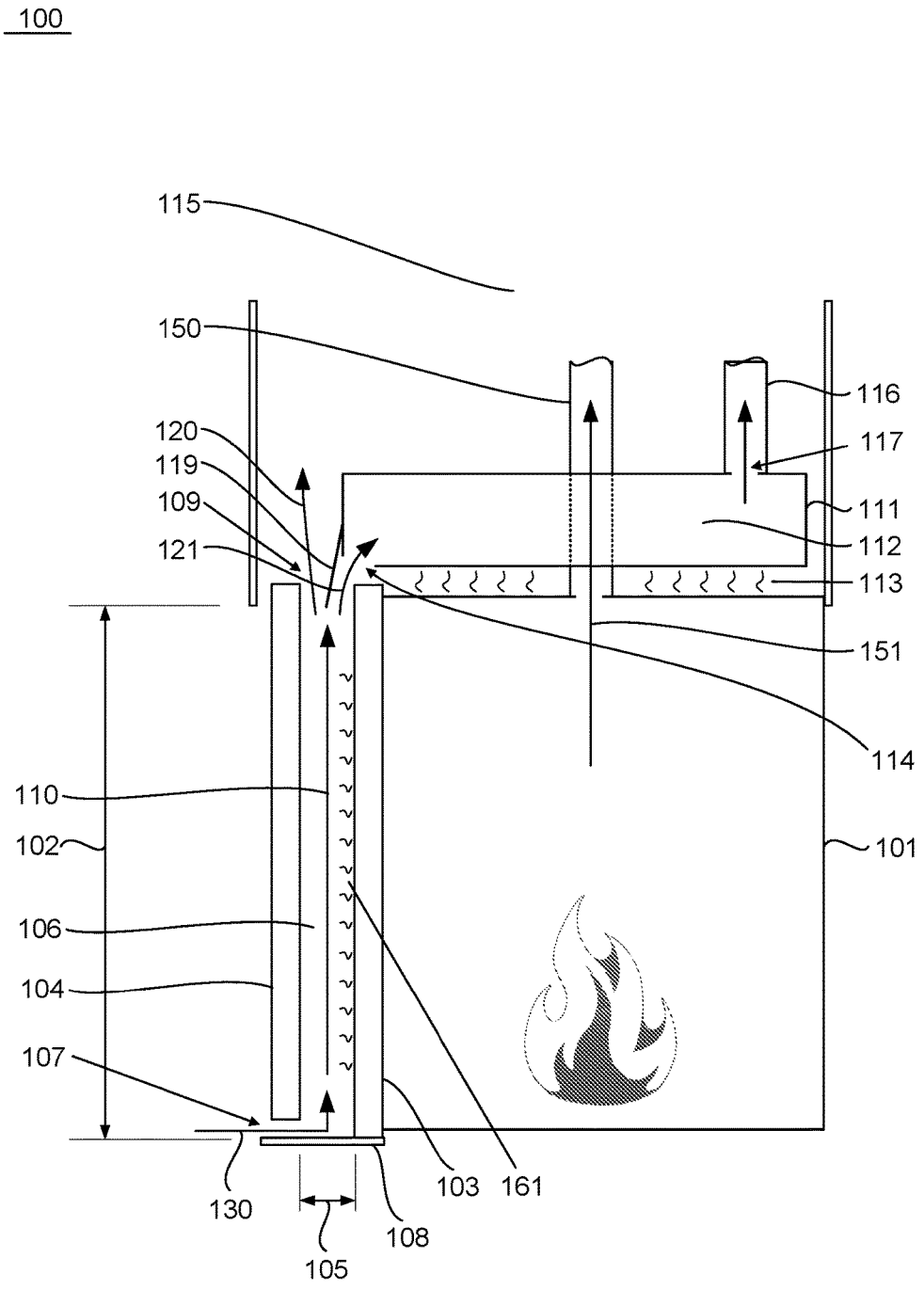
FIG. 1 illustrates a side view block diagram of a fireplace system in accordance with various embodiments of the present disclosure.

The systems and methods of the present disclosure may be described herein in terms of various functional components. It should be appreciated that such functional components may be realized by any number of hardware components configured to perform the specified functions. In addition, the present disclosure may be practiced in any number of firebox and/or fireplace system contexts and the systems and methods described herein are merely exemplary embodiments. Further, it should be noted that any number of fireplace system and safety barrier configurations may be adapted to achieve the various functions and benefits described herein, and such general techniques that may be known to those skilled in the art are not described in detail herein.

As used herein, the term "convective heat transfer" refers to the transfer of thermal energy by mass fluid flow, such as bulk air flow. As used herein, convective heat transfer includes the processes of advection as well as diffusion. The phenomenon of convective heat transfer may also be referred to simply as "convection" herein. "Natural convection" refers to convection that occurs as a result of relative density (i.e., relative buoyancy) changes between two portions of a fluid that are in fluid communication, thereby producing mass fluid flow. As used herein, natural convection includes convection produced by application of thermal energy to a volume of a fluid such as air. For example, natural convection may be produced by application of heat to a first volume of air, with the thermal energy input producing a decrease in the density of the air, thereby increasing the buoyancy of the air relative to a second volume of air, such as ambient air, in fluid communication with the first volume of air. This may produce bulk air flow of the heated air if it is vented into an ambient air space. In contrast, for purposes of the present disclosure, the term "forced convection" refers to mass fluid flow produced by an external mechanical force, such as by operation of a fan or a blower.

In accordance with various embodiments of the present disclosure and as described in greater detail below, a fireplace system and method can provide for operational safety of a fireplace safety barrier relying on natural convection to maintain a safe operating temperature of the outer safety barrier and/or using inconspicuous natural convection cooling system inlets and outlets. A fireplace system can comprise a firebox with a firebox opening, a first safety barrier and a second safety barrier defining an interbarrier space, and an interbarrier space inlet and an interbarrier space outlet. A fireplace system can comprise one or more additional safety barriers, such as a third safety barrier, disposed in the interbarrier space. A fireplace system may optionally further comprise a firebox top heat exchanger in fluid communication with the interbarrier space and an outlet duct operatively coupled to the firebox top heat exchanger. A fireplace system in accordance with various embodiments may be configured to provide for natural convection cooling of the second safety barrier during operation of the fireplace system without a need for an electromechanical, forced convection air management component. However, a fireplace system in accordance with various embodiments of the present disclosure may comprise a forced convection system component such as a fan or blower in addition to the various features of the fireplace systems described herein, and nothing in the present disclosure should be interpreted to prohibit inclusion of such a component in a fireplace system.

Referring now to FIG. 1, a schematic diagram of a fireplace system 100 in accordance with various embodiments is illustrated. Fireplace system 100 can comprise a firebox 101. The fireplace system may further define a firebox opening 102. The firebox opening 102 defined by the fireplace system may provide visibility of the interior of the firebox and a fire feature and/or flame when fireplace system 100 is in operation. In various embodiments, a fire feature can comprise a burner, fire rock or fire glass, ceramic gas fireplace logs, and the like. Fireplace system 100 can also comprise a wood or pellet burning fireplace, with firebox opening 102 providing visibility of the combustion fuel and/or flame during operation of the fireplace.

Firebox 101 and firebox opening 102 can have any of a number of configurations in accordance with various embodiments. The diagram of fireplace system 100 illustrated in FIG. 1 is shown with a firebox opening 102 on a single side of firebox 101 for simplicity. However, a fireplace system and firebox may have firebox openings on one, two, three, four, or more sides in accordance with various embodiments of the systems and methods disclosed herein. Likewise, a firebox and firebox opening need not be configured as a substantially vertical, flat or two-dimensional plane as illustrated for firebox opening 102. In various embodiments, a firebox and/or fireplace system can define a curved fireplace opening. For example, in various embodiments, a firebox opening can comprise a segment of a semicircle, a segment of an ellipse, or another curved shape. Similarly, a firebox opening need not comprise straight edges. For example, a top edge of a fireplace opening can be arched or have another nonlinear configuration. A fireplace system in accordance with various embodiments can have any of a variety of firebox opening configurations that are known in the art. Moreover, a firebox opening can be defined by a firebox shell, various components of fireplace system such as one or more fireplace surround components (described in greater detail below), firebox top components, and the like.

In accordance with various embodiments, fireplace system 100 comprises a safety barrier enclosing firebox opening 102. For example, a first safety barrier 103 may be disposed across firebox opening 102 immediately adjacent to the shell of firebox 101. In various embodiments, first safety barrier 103 may be coupled to the shell of firebox 101, thereby enclosing the firebox at opening 102, which may, as depicted in FIG. 1, for example, fluidly isolate firebox 101 from ambient room air and/or air within or proximate to interbarrier space 106. Fireplace system 100 can further comprise a second safety barrier 104 disposed in front of first safety barrier 103. Additional safety barriers may be disposed between the first and second safety barriers, as described in more detail below. A front surface of first safety barrier 103 and a rear surface of second safety barrier 104 may define an interbarrier offset 105 and partially define and enclose an interbarrier space 106. As described in greater detail below, in various embodiments, the dimension of interbarrier offset 105 may be configured (along with various other features of a fireplace system described herein) to provide for a safe operating temperature of the second safety barrier. A fireplace system can further comprise one or more additional safety barriers disposed between the first safety barrier and the second safety barrier. For example, and with reference briefly to FIGS. 4A-4G, a fireplace system can comprise third safety barrier 460 disposed between first safety barrier 403 and second safety barrier 404. A fireplace system may be configured with any number of safety barriers (e.g., three, four, or more) suitable to achieve a desired maximum outer safety barrier temperature during operation of a fireplace system.

In various embodiments, a variety of fireplace system parameters such as the dimension of interbarrier offset 105 and configuration of interbarrier space 106 can be adapted relative to other aspects of a fireplace system (e.g., the dimensions of a firebox, firebox opening configuration, fireplace system burner output, etc.) to provide a suitable temperature differential between first safety barrier 103 and second safety barrier 104. Without wishing to be bound by theory, different interbarrier offset dimensions may confer different interbarrier space 106 volumes with different insulative values and/or air flow potentials, thereby contributing to different temperature differentials between first safety barrier 103 and second safety barrier 104. In various embodiments, interbarrier offset 105 can be between about 5 mm and about 200 mm, between about 10 mm and about 175 mm, between about 20 mm and about 150 mm, between about 40 mm and about 125 mm, between about 60 and about 100 mm, or about 75 mm.

Interbarrier space 106 may be defined or enclosed on the sides by other components of fireplace system 100, or the sides may be in fluid communication with one or more interbarrier spaces defined between adjoining safety barriers enclosing adjacent sides of firebox 101 that may also comprise a firebox opening providing visibility to the interior of the firebox. An interbarrier space may comprise a partially enclosed air space and may be in fluid communication with ambient room air and/or other components of fireplace system 100 via an interbarrier space inlet, an interbarrier space outlet, or other gaps or spaces between edges of a safety barrier and an adjacent component of fireplace system 100 contributing to defining interbarrier space 106. Moreover, interbarrier space 106 may comprise an additional barrier (e.g., a third safety barrier such as third safety barrier 460 illustrated in FIGS. 4A-4G) disposed between the first and second safety barrier that may further contribute to a temperature reduction between the first and second safety barrier. Any of a variety of firebox opening and safety barrier configurations are possible and within the scope of the present disclosure.

A fireplace system safety barrier can comprise a variety of different materials and configurations suitable to provide various levels of light transmission and/or heat transmission. For example, a safety barrier can comprise various compositions of glass, framed or frameless metal mesh, or various combinations thereof. In accordance with various embodiments, it is desirable to select a safety barrier configuration that provides a maximum degree of visible light transmission for maximum visibility of a fire feature housed in firebox 101 during operation of fireplace system 100. Moreover, a safety barrier configuration used in a fireplace system may be adjusted in response to various factors such as fireplace sizes, opening sizes and configurations, burner outputs, cavity or chase size and configuration, chase vent configuration, fireplace placement and configuration, and the like.

In various embodiments, first safety barrier 103 and second safety barrier 104 may each comprise a glass material. For example, in an embodiment, first safety barrier 103 can comprise a 5 mm thick ceramic glass pane, and second safety barrier 104 can comprise a 5 mm thick tempered glass pane. Other glass safety barrier compositions and configurations are possible, such as glass panes between about 2 mm and about 15 mm thick, including, for example, panes that are about 6 mm, about 7 mm, about 8 mm, about 9 mm, or about 10 mm thick. Glass panes of any suitable thicknesses may be used in accordance with various embodiments, and glass panes of the same or different thickness may likewise be used at different safety barrier positions (i.e., first, second, third, etc.) in a fireplace system. For example, a fireplace system can comprise a 5 mm thick first safety barrier, a 5 mm thick second safety barrier, and a 3 mm thick third safety barrier disposed in the interbarrier space. Likewise, glass panes of any suitable glass type may be used in any combination, such as all ceramic glass, all tempered glass, or various permutations thereof. In certain embodiments, while various glass safety barrier configurations may be suitable for a firebox system, certain configurations may provide more or less optimal performance. For example, in certain embodiments, a 10 mm thick tempered glass pane used as a second safety barrier may produce elevated temperatures at the outer surface of the second safety barrier relative to a 5 mm thick tempered glass pane, possibly due to higher absorbance of radiant energy by the thicker pane. Similarly, in an embodiment comprising a high output fireplace system capable of producing temperatures in the firebox of over 260° C., a ceramic glass pane as a first safety barrier (i.e., inner barrier enclosing firebox opening) may provide more optimal performance than a tempered glass pane, which may become brittle at elevated temperatures.

In various embodiments, a safety barrier may comprise a metal mesh screen, either alone or coupled to a glass pane. However, while metal mesh screens may facilitate achieving safe operating temperatures for a fireplace system, for example, by reducing radiant thermal energy output and/or by distributing heat via thermal conduction, metal mesh safety barriers also reduce visible light transmission from a fire, thereby diminishing the aesthetic value of the light output from a fire during operation of the fireplace system. Thus, in various embodiments, fireplace system 100 does not comprise a safety barrier with a metal mesh screen, though such screens are not precluded from being used in accordance with various embodiments of the present disclosure.

As described in greater detail below, various components of fireplace system 100, such as first safety barrier 103 and second safety barrier 104, can be configured so that interbarrier space 106 is in fluid communication with ambient air or room air via an interbarrier space inlet 107. In accordance with various embodiments, the position of interbarrier space inlet 107 may be located substantially within the area defined by firebox opening 102. For example, a lower aspect of firebox opening 102 may be defined by a component such as lower fireplace surround 108, and interbarrier space inlet 107 can comprise an inlet aperture between the lower edge of second safety barrier 104 and an upper surface of lower firebox surround 108. Thus, in various embodiments, interbarrier space inlet 107 and an interbarrier space inlet airflow path 130 defined by the lower edge of second safety barrier 104 and lower firebox opening surround 108 are located substantially within the area defined by firebox opening 102.

The inlet aperture may be an opening with a dimension suitable to permit sufficient airflow into the interbarrier space while providing for safe operation of the fireplace system and preventing potential user contact with the first safety barrier. The inlet aperture dimension may be specified for compliance with applicable safety standards and may vary depending on the distance of the second safety barrier from the first safety barrier. Safety testing for compliance with safety standards may be performed, for example, by testing for an ability to prevent ingress of a specified testing probe. In various embodiments of a fireplace system with an interbarrier offset of about 75 mm, the inlet aperture dimension can be about 15 mm while meeting applicable safety standards and providing sufficient airflow into the interbarrier space. Other inlet aperture dimensions, such as between about 5 mm and about 30 mm, or between about 10 mm and about 25 mm, may provide suitable airflow performance and cooling of the outer safety barrier. For larger inlet aperture dimensions, an additional inlet barrier such as a small glass barrier, a metal rod, a grate, a louvre, or other barrier feature may be used to maintain compliance with safety standards. In various embodiments, a larger inlet aperture may provide for increased airflow into the interbarrier space and increased cooling of the second safety barrier or fireplace system, though an additional barrier may be less aesthetically desirable than an inlet aperture without such an additional barrier.

In various embodiments, a fireplace system comprising a second safety barrier and an inlet aperture defined by the lower edge of the second safety barrier and the upper surface of a lower firebox opening surround may further comprise one or more safety barrier brackets. A safety barrier bracket may be configured to secure the second safety barrier in a fixed position relative to the fireplace system. A safety barrier bracket may be configured to be modular and removable and/or adjustable with respect to another component of the fireplace system to which it may be attached, such as a firebox frame or wall, a heat exchanger, lower firebox surround, etc. For example, and with reference briefly to FIG. 5I, a fireplace system may comprise a plurality of brackets 570 configured to support an upper edge of a safety barrier. The brackets may be removably attached to a fireplace system, such as by attachment to a firebox top, heat exchanger, surround, or other component of the fireplace system. Moreover, brackets 570 may be concealed from view within the upper structure of the fireplace system located behind the finished fireplace, providing the appearance that the second safety barrier is "floating" in front of the fireplace opening with no visible structural support to detract from the aesthetic appearance of the fireplace opening. A variety of safety barrier bracket subcomponents may be provided to modularly accommodate different safety barrier thicknesses and/or to provide different interbarrier offset dimensions or inlet aperture heights. In this manner, different safety barrier brackets may be selected from a range of safety barrier bracket options to provide a firebox or fireplace system with different safety barrier configurations that may be selected based on consumer preferences, different safety regulation requirements, different fireplace installations, and the like. Other safety barrier bracket configurations may be suitable to secure a safety barrier in a position that provides an interbarrier space and interbarrier space inlet as described herein, such as side-mounted or bottom-mounted brackets or other stands or supports may also be suitable to secure a second safety barrier in a manner that achieves the various functional aspects of a fireplace system described herein while also providing for an aesthetically pleasing fireplace opening.

Figure 2:
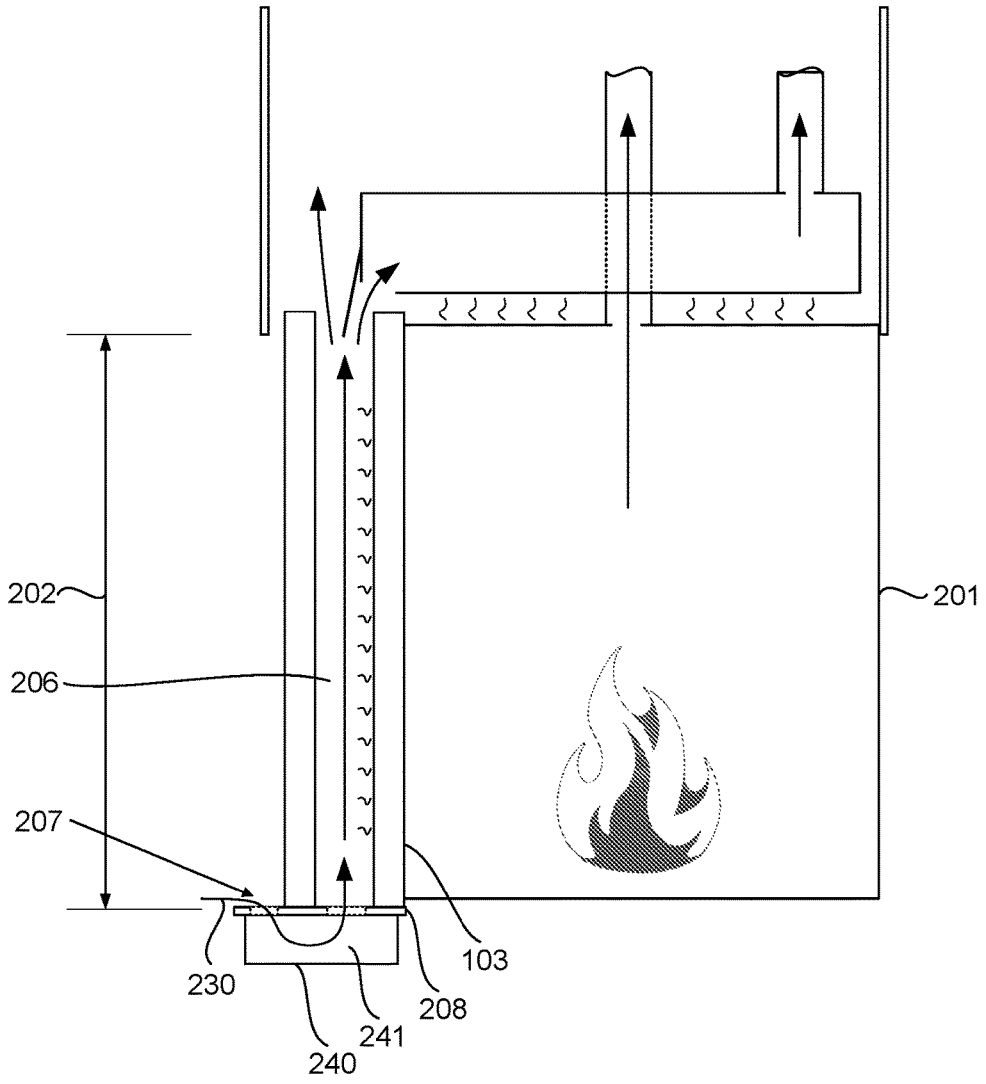
FIG. 2 illustrates a side view block diagram of a fireplace system in accordance with various embodiments of the present disclosure.

In various embodiments and with reference now to FIG. 2, the position of an interbarrier space inlet may also be considered substantially within the area defined by a firebox opening, even though the inlet airflow path is partially outside of the area defined by the firebox opening. For example, an interbarrier space inlet may be located in a component of the fireplace system that defines a firebox opening, or a fireplace system can comprise an airflow path that is partially outside of the area defined by a firebox opening. In the illustrated embodiment, fireplace system 200 comprises a firebox 201 with a firebox opening 202 defined in part by a lower firebox surround 208 coupled to a channel component 240 that defines a channel 241 beneath surround 208. Surround 208 can further define interbarrier space inlet 207. Interbarrier space inlet 207 can comprise slots or penetrations in the upper surface of surround 208 to provide an airflow path 230 from an area outside of the fireplace, through channel 241 and into interbarrier space 206. Thus, interbarrier space inlet 207 is substantially within an area defined by firebox opening 202, while interbarrier space inlet airflow path 230 is directed outside of the area defined by firebox opening 202 prior to entering interbarrier space 206.

Various other configurations of interbarrier space inlets are possible and within the scope of the present disclosure. The particular aspects of interbarrier space inlet configurations may vary while providing sufficient airflow into the interbarrier space of a fireplace system to achieve the cooling and safety functions described in greater detail below. Likewise, a variety of interbarrier space inlet configurations may be used while achieving a desired aesthetic in accordance with various embodiments of the fireplace systems described herein, such as limiting the portions of an interbarrier space inlet visible to a user to the area defined by a firebox opening while not impinging on the viewable area of the firebox opening.

Referring again to FIG. 1, the interbarrier space 106 of fireplace system 100 may further comprise an interbarrier space outlet 109. Interbarrier space outlet 109 may be located near an upper edge of interbarrier space 106. In accordance with various embodiments, interbarrier space outlet 109 may have a configuration suitable to vent interbarrier space airflow 110 from interbarrier space 106. Such airflow may be created, for example, by heating air located in interbarrier space 106 during operation of fireplace system 100 to produce buoyant air in the interbarrier space. As described in greater detail below, air in interbarrier space 106 may be heated by transfer of thermal energy 161 from firebox 101 to interbarrier space 106, such as by conduction of thermal energy through first safety barrier 103 and/or by radiative thermal energy transfer.

In various embodiments, a fireplace system 100 may optionally comprise a heat exchanger such as firebox top heat exchanger 111. Firebox top heat exchanger 111 may comprise an enclosure configured to enclose a first volume of air 112 and to receive thermal energy 161 from the firebox during operation of the fireplace system. For purposes of clarity, firebox top heat exchanger 111 is illustrated as a separate component from the upper wall of the shell of firebox 101 in the schematic diagram of fireplace system 100 shown in FIG. 1. In accordance with various embodiments, firebox top heat exchanger 111 and first volume of air 112 are not in fluid communication with the combustion chamber of firebox 101. However, while the optional firebox top heat exchanger 111 of fireplace system 100 is a distinct functional component of the fireplace system, a heat exchanger may be configured as a separate physical component that is attached to the shell of firebox 101 in assembled fireplace system 100, or a heat exchanger may be an integral or unitarily constructed component of firebox 101. For example, firebox top heat exchanger 111 can comprise an enclosure with a lower wall that attaches to and/or is placed in contact with or adjacent to an upper wall of the shell of firebox 101, or the upper wall of the shell of firebox 101 may be shared with (i.e., integral to) and/or comprise the lower wall of firebox top heat exchanger 111. The diagram of fireplace system 100 in FIG. 1, including the configurations shown for firebox 101 and firebox top heat exchanger 111 and the space therebetween, should not be interpreted as depicting any particular structural limitation, configuration, or spatial relationship of the various components shown, but instead is merely intended to illustrate various functional aspects of a fireplace system in accordance with various embodiments.

In accordance with various embodiments, an upper wall of the shell of firebox 101 and/or the lower wall of firebox top heat exchanger 111 can be constructed from materials suitable to provide effective thermal energy transfer from the firebox 101 to the firebox top heat exchanger 111 during operation of the fireplace system. For example, various metals or metal alloys such as copper, aluminum, steel, or iron may be selected based on thermal conduction properties to provide efficient transmission of thermal energy 113 from the firebox 101 to the firebox top heat exchanger 111. These components can also be provided with any of a variety of configurations known by a person of ordinary skill in the art to enhance thermal energy transfer, such an extended surface configuration using curves, corrugations, fins, and the like.

In accordance with various embodiments, the first volume of air 112 in firebox top heat exchanger 111 is in fluid communication with interbarrier space 106. Firebox top heat exchanger 111 can comprise a heat exchanger inlet 114 in fluid communication with interbarrier space outlet 109. Heat exchanger inlet 114 can comprise an opening such as a slot or a pattern of openings disposed in a wall of firebox top heat exchanger 111 and suitable to permit airflow into the heat exchanger.

Fireplace system 100 can further comprise an outlet duct 116. Outlet duct 116 may be operatively coupled to firebox top heat exchanger 111. Firebox top heat exchanger 111 may define an opening such as heat exchanger outlet 117 configured to vent the first volume of air 112 enclosed by firebox top heat exchanger 111. For example, heat exchanger outlet 117 may be located in an upper wall of firebox top heat exchanger 111 and be configured to vent first volume of air 112 after it has become buoyant relative to ambient air during operation of fireplace system 100. Outlet duct 116 may be modularly and removably coupled at a proximal end to firebox top heat exchanger 111 at the location of heat exchanger outlet 117, for example, using an adapter plate, collar, flange or similar device for coupling a duct to an outlet. In accordance with various embodiments, heat exchanger outlet 117 and outlet duct 116 may define a secure outlet pathway in fluid communication with the first volume of air 112 enclosed by firebox top heat exchanger 111 and interbarrier space 106.

Figure 3:
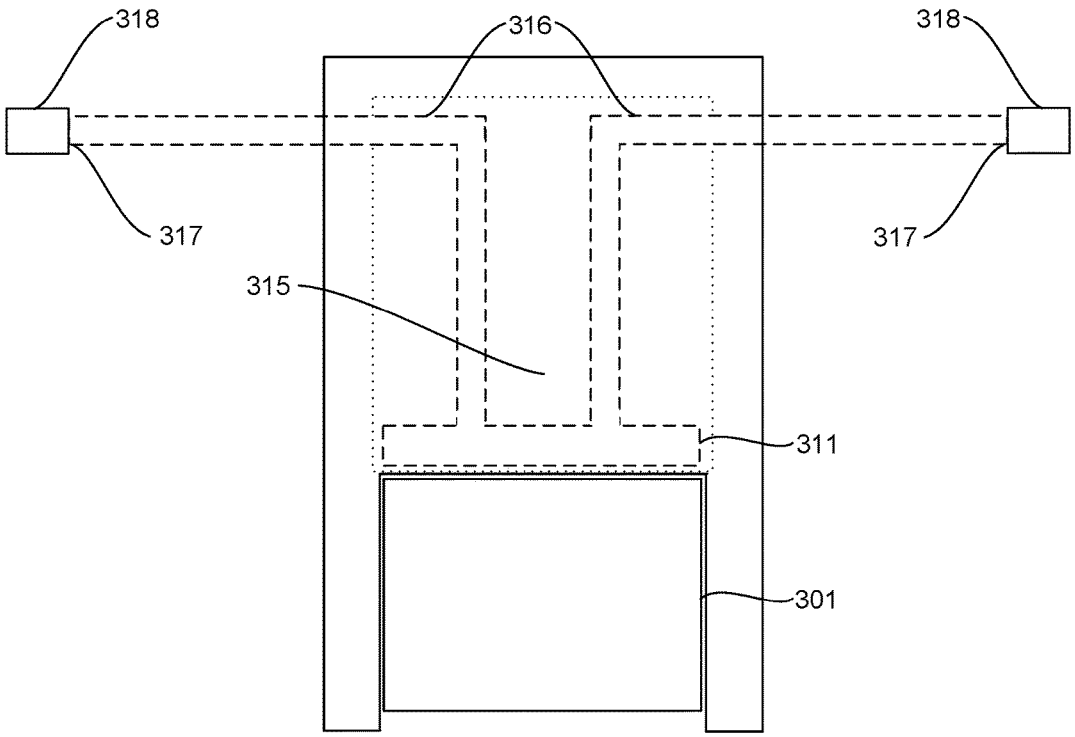
FIG. 3 illustrates a front view block diagram of a fireplace system in accordance with various embodiments of the present disclosure.
Figure 4A:
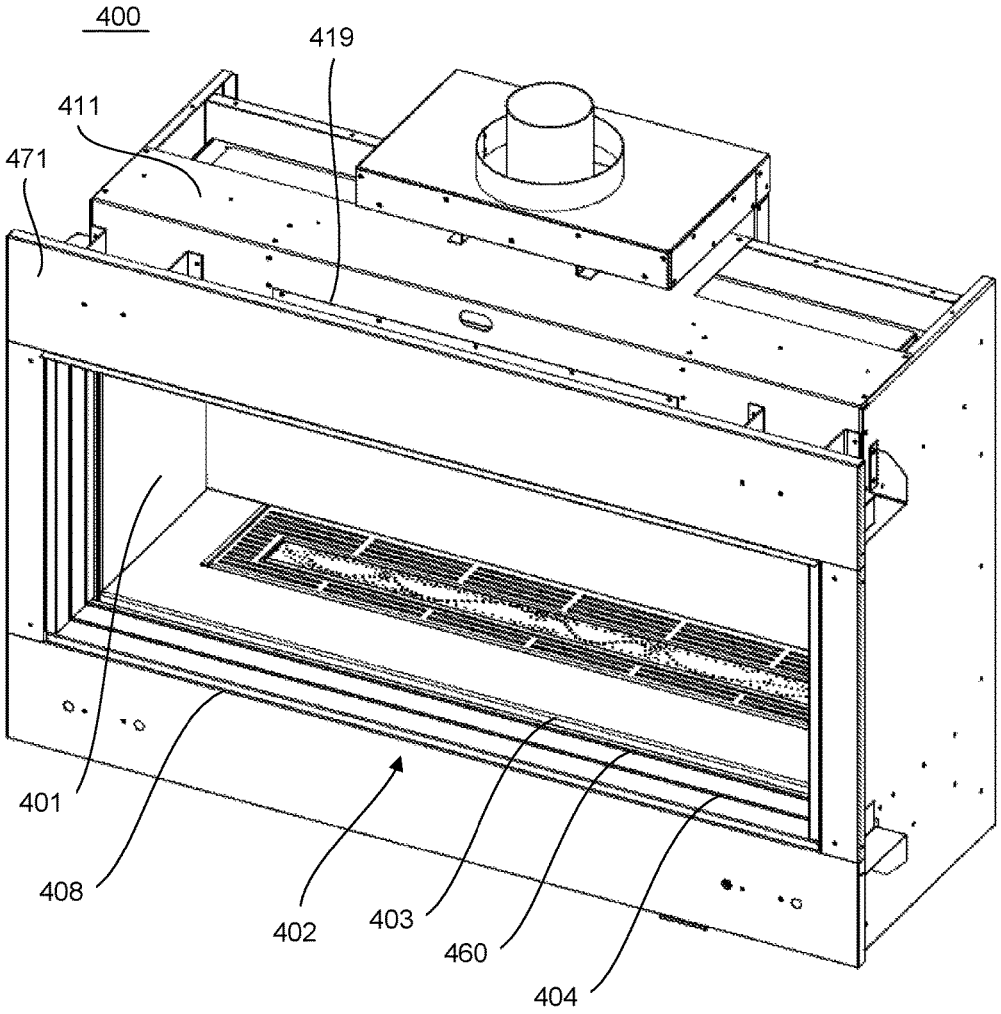
FIG. 4A illustrates a perspective view of a fireplace system in accordance with various embodiments of the present disclosure.
Figure 4B:
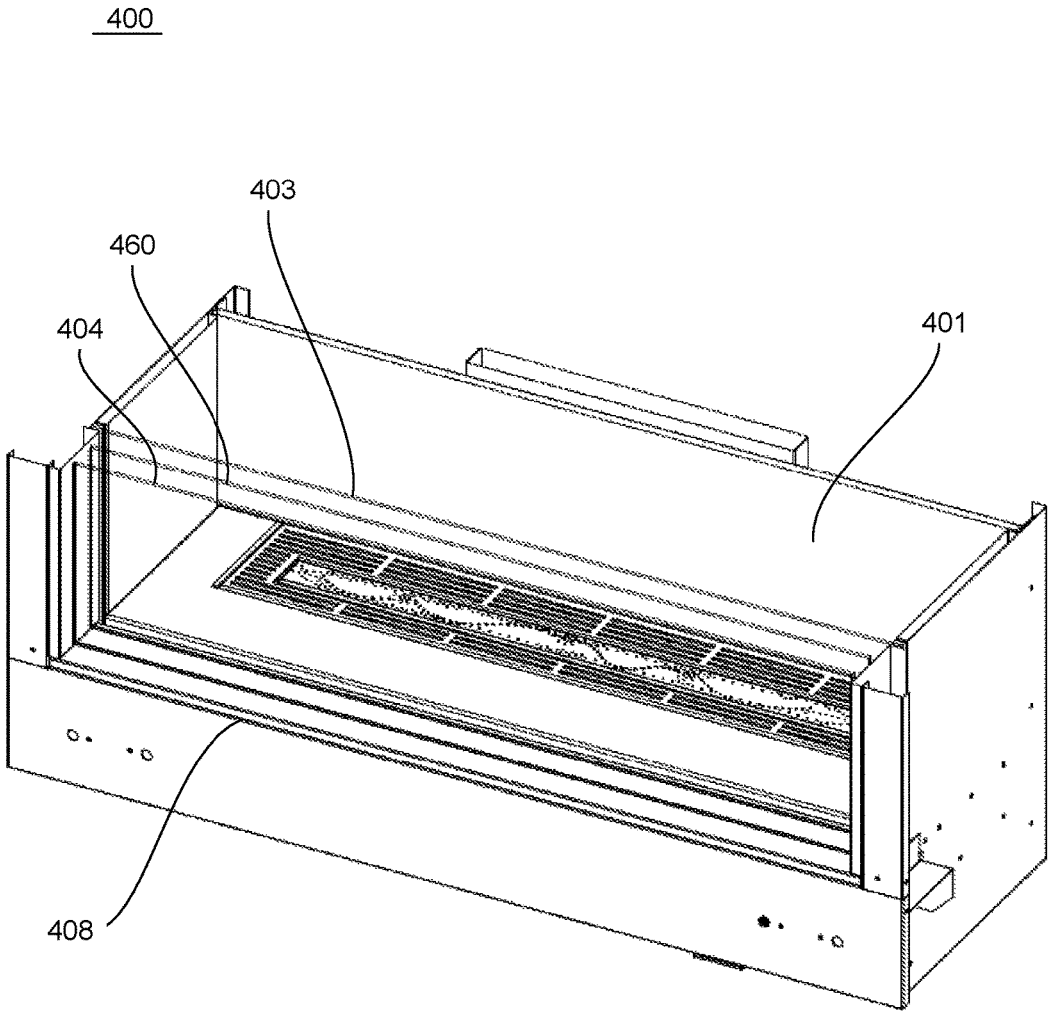
FIG. 4B illustrates a cutaway perspective view of a fireplace system in accordance with various embodiments of the present disclosure.
Figure 4C:
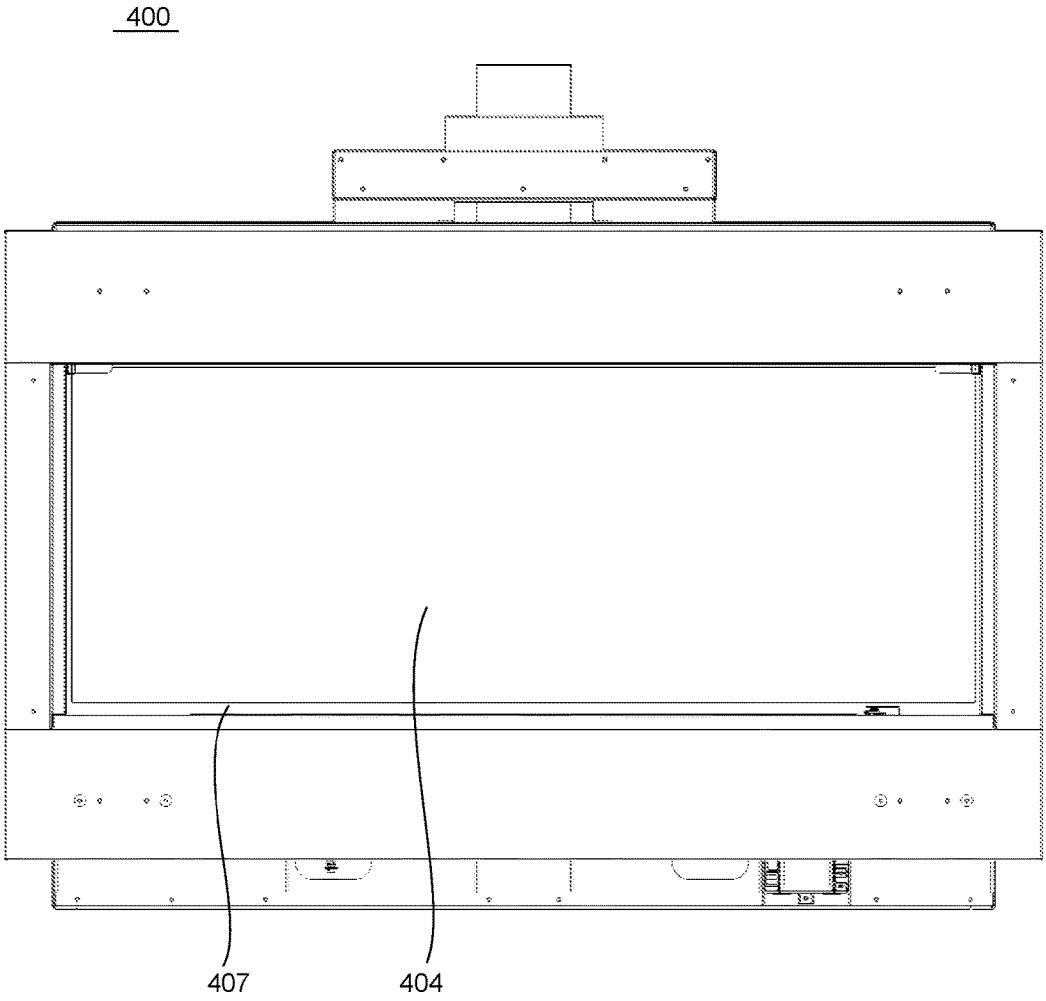
FIG. 4C illustrates a front view of a fireplace system in accordance with various embodiments of the present disclosure.
Figure 4D:
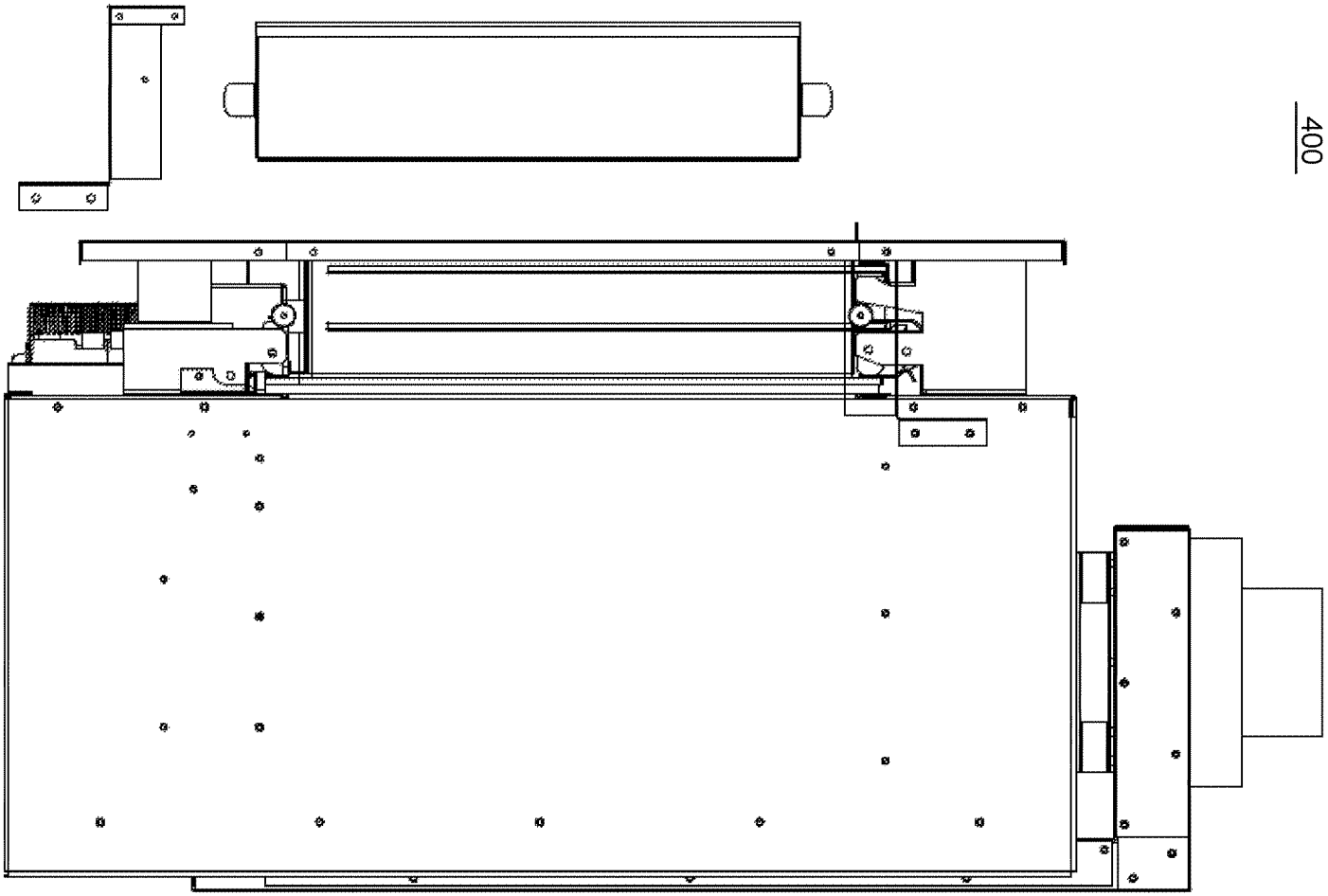
FIG. 4D illustrates a partially exploded side view of a fireplace system in accordance with various embodiments of the present disclosure.
Figure 4E:
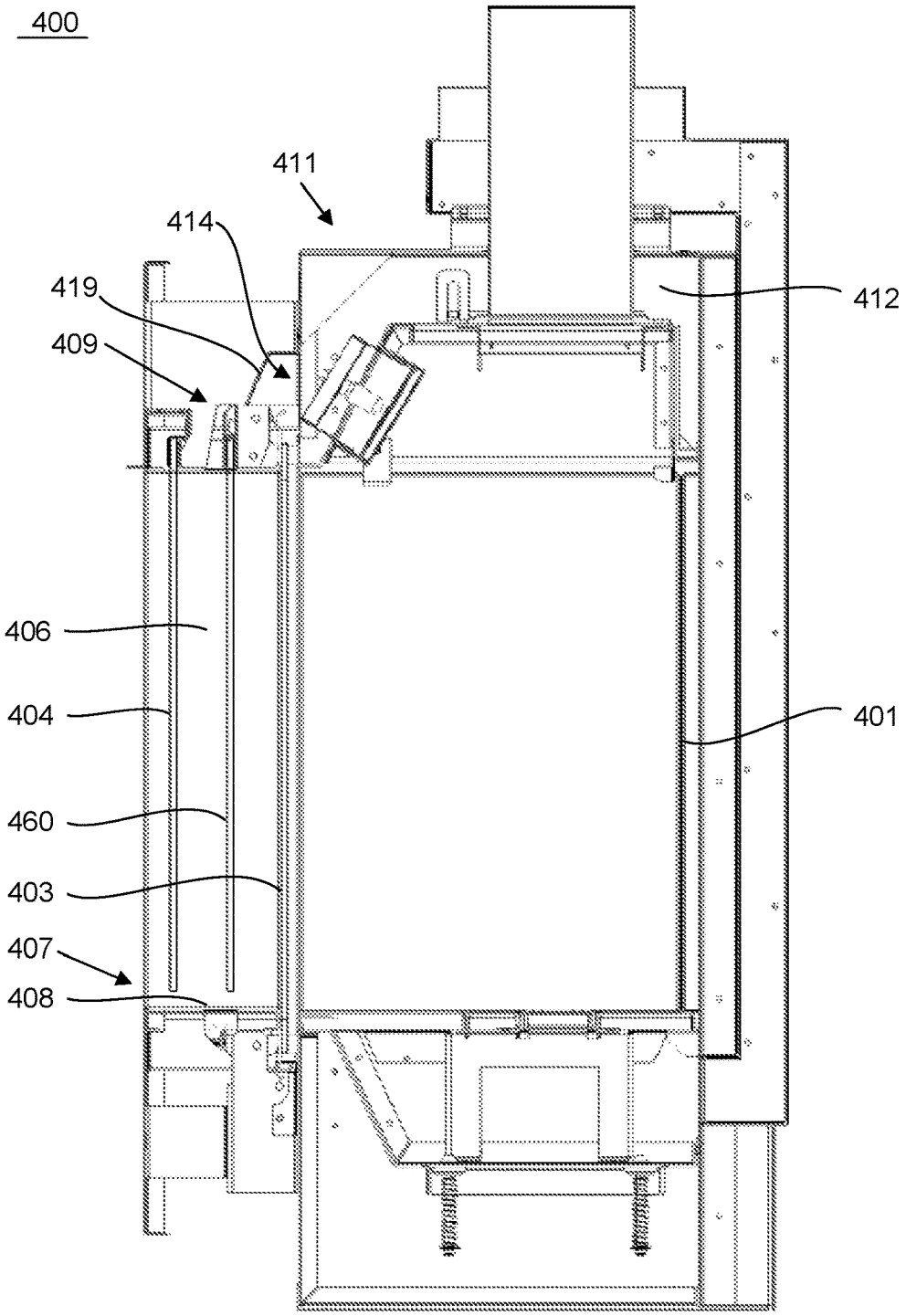
FIG. 4E illustrates a cutaway side view of a fireplace system in accordance with various embodiments of the present disclosure.
Figure 4F:
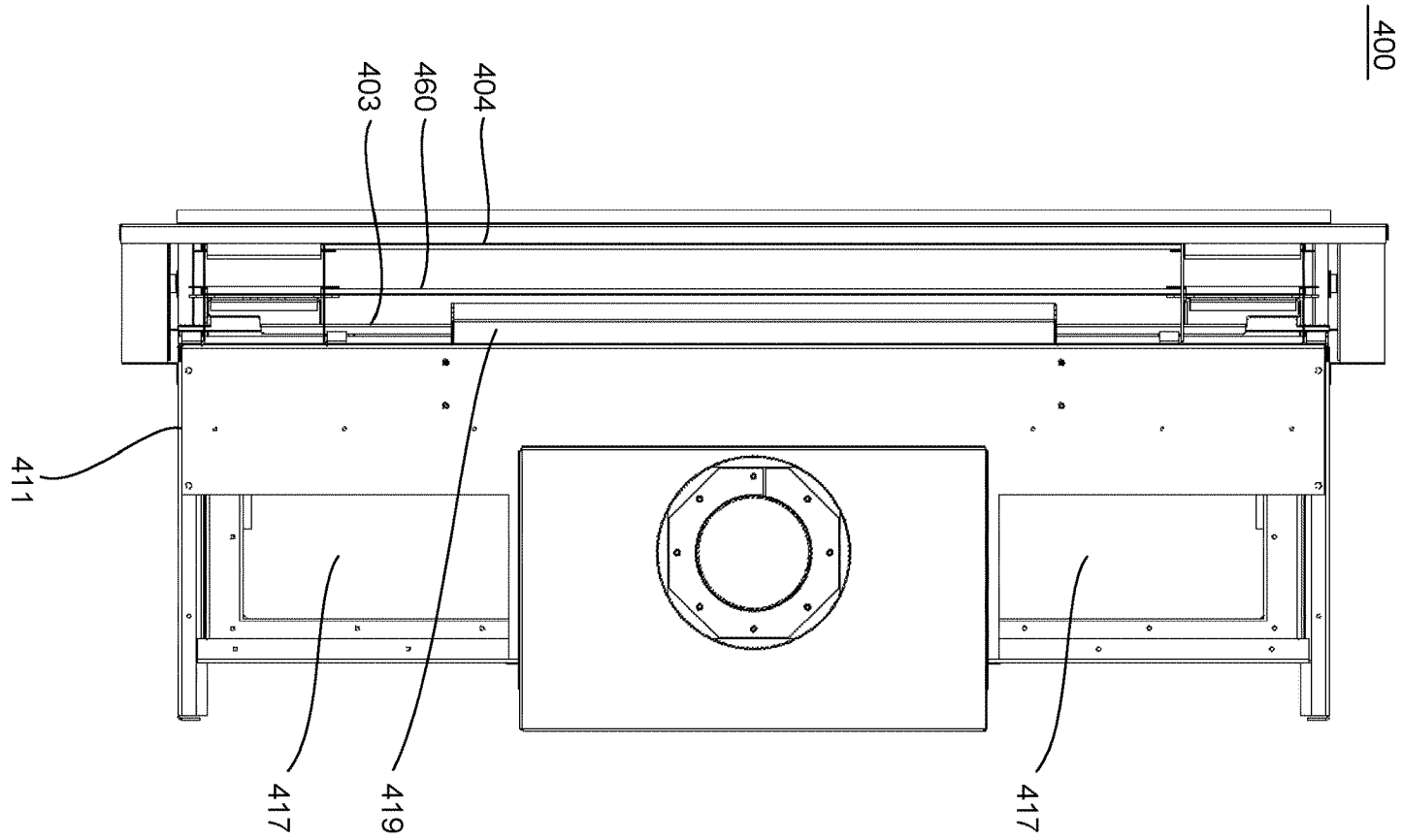
FIG. 4F illustrates a top view of a fireplace system in accordance with various embodiments of the present disclosure.
Figure 4G:
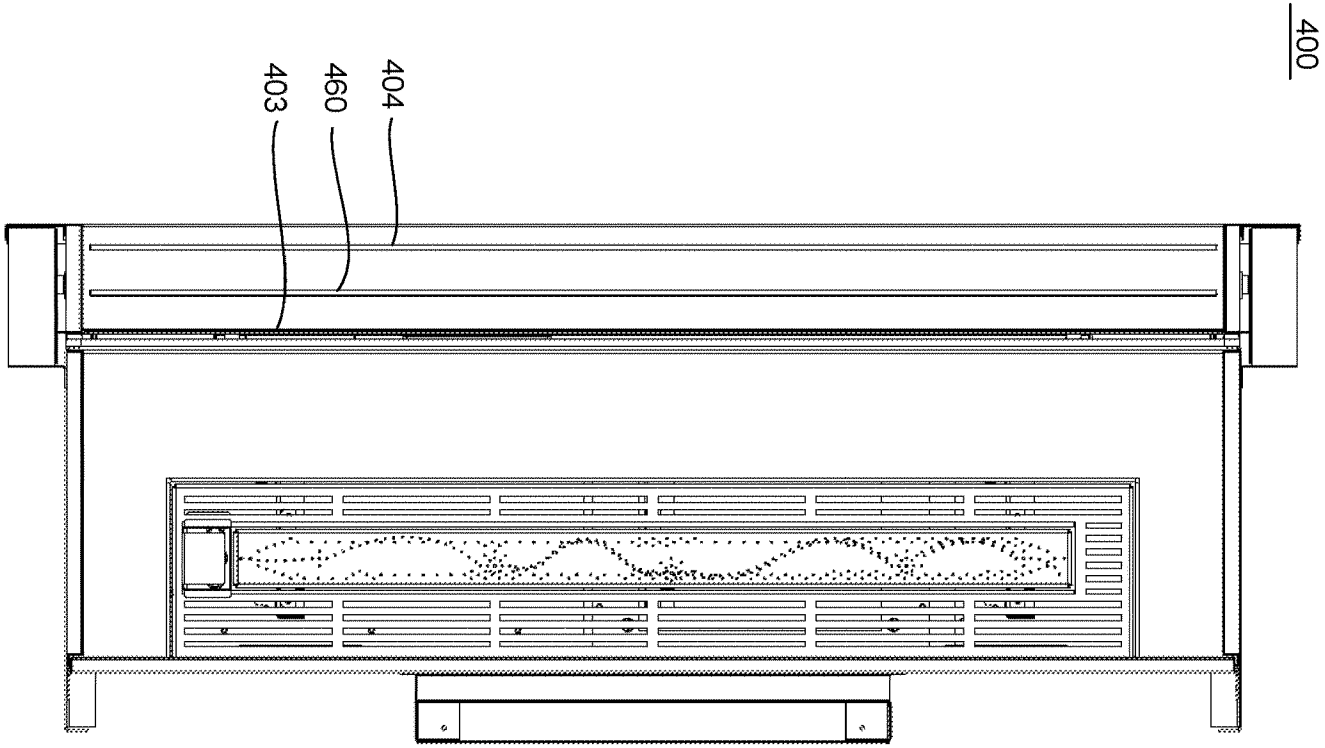
FIG. 4G illustrates a cutaway top view of a fireplace system in accordance with various embodiments of the present disclosure.

With reference briefly to FIG. 3, in various embodiments, a distal end 317 of outlet duct 316 may be located at an external location 318. External location 318 may be located away from the general location of fireplace system 300, for example, outside of and lateral to the chase or structure enclosing upper cavity 315 (i.e., the space above the fireplace enclosed within a chase) above firebox 301. The length of an outlet duct 316 can be varied in accordance with the requirements of a particular fireplace system installation. In various embodiments, a fireplace system can comprise a plurality of outlet ducts 316, with each outlet duct configured to vent to a different external location 318. As illustrated in FIG. 3, a fireplace system in accordance with various embodiments may be configured to direct air heated in firebox top heat exchanger 311 during operation of firebox 301 to an external location outside of cavity 315 and remote from the general location of firebox 301. In this manner, a fireplace system in accordance with the present disclosure can distribute heat produced by operation of the fireplace system to distant parts of a room while providing for an enhanced aesthetic appearance of the fireplace opening due to the remote location of the distal ends of the outlet ducts. Moreover, in accordance with various embodiments, the outlet duct configuration and the location(s) of the distal ends may have a configuration suitable to facilitate air flow from the fireplace system by natural convection, such as due to having a location above the level of firebox 301 and firebox top heat exchanger 311. However, a fireplace system in accordance with various embodiments need not comprise an outlet duct, and an interbarrier space and/or heat exchanger may vent into cavity 315. Cavity 315 can further comprise vents that provide fluid communication between cavity 315 and ambient air in the adjacent room. Thus, various airflow paths out of a fireplace system are possible and within the scope of the present disclosure.

With reference again to FIG. 1, firebox top heat exchanger 111 may further optionally comprise a cowl 119. Cowl 119 may be configured to control the direction of airflow from interbarrier space 106 and/or interbarrier space outlet 109. For example and as illustrated in FIG. 1, cowl 119 may be configured to direct a portion of the airflow from interbarrier space 106 into heat exchanger inlet 114, such as by being partially disposed in interbarrier space outlet 109 at an angle suitable to direct airflow into inlet 114. In various embodiments, cowl 119 may be configured to direct all or a portion of airflow from interbarrier space 106 into heat exchanger inlet 114. For example and as shown in FIG. 1, cowl 119 may be configured to permit a portion of the airflow from interbarrier space 106 to exit interbarrier space outlet 109 in front of cowl 119 and enter into upper cavity 115 above fireplace system 100. Stated differently, in various embodiments, fireplace system 100 can comprise a cowl 119 configured to divide interbarrier space airflow 110 exiting interbarrier space outlet 109 between a first airflow path 120 (such as into inlet 114) and a second airflow path 121 (such as into upper cavity 115).

In accordance with various embodiments of a fireplace system, cowl 119 is not required. Instead, a fireplace system can comprise a manifold or other configuration or component to provide a secure airflow pathway from interbarrier space 106 to inlet 114 of firebox top heat exchanger 111. Moreover, in various embodiments and as mentioned above, a fireplace system need not comprise a firebox top heat exchanger, and instead, air from interbarrier space 106 may be vented into upper cavity 115 or into an outlet duct configured to direct airflow to a remote location.

In various embodiments, a cowl such as cowl 119 may have a fixed position relative to the heat exchanger and/or other components of fireplace system 100, or a cowl may be adjustable. An adjustable cowl may be adjusted during assembly or installation of a fireplace system, for example, to accommodate various fireplace system parameters that might be adjusted based on the requirements of a particular installation, such as a room configuration, upper cavity configuration, vent duct length and outlet location, and the like. In various embodiments, a cowl may be user- or operator-adjustable following installation of fireplace system 100. Moreover, a cowl need not be attached to firebox top heat exchanger 111, but instead may be attached to or supported by other components of a fireplace system. Any configuration of a cowl that may be conceived by a person of ordinary skill in the art may be used for a fireplace system in accordance with various embodiments of the present disclosure.

Fireplace system 100 may also comprise an exhaust flue 150 configured to conduct combustion exhaust gases 151 out of firebox 101. In various embodiments, exhaust flue 150 may comprise a unitary flue or multiple components coupled to one another to form a channel suitable to conduct exhaust gases 151 from the firebox 101 to a chimney or other vent, such as a direct vent. As illustrated for fireplace system 100, an exhaust flue 150 may be configured to channel exhaust gases 151 through a firebox top heat exchanger 111. A firebox top heat exchanger can comprise a component of and/or be attached to flue 150. For example, firebox top heat exchanger 111 can comprise a pipe or channel disposed through heat exchanger 111 and configured to conduct exhaust gases 151 through heat exchanger 111 while preventing exhaust gases 151 from entering the first volume of air 112. In various embodiments, heat exchanger 111 and exhaust flue 150 may be configured to transfer thermal energy from exhaust gases 151 to first volume of air 112 in heat exchanger 111. In various embodiments, flue 150 need not comprise a component of or be attached to a heat exchanger 111, and instead may be physically separate from and/or located away from any heat exchanger component of a fireplace system. Likewise, a flue may have any of a variety of possible configurations known in the art, such as a coaxial configuration suitable to conduct exhaust gas out of the fireplace system while conducting combustion inlet air into the fireplace system.

Referring now to FIGS. 4A-4G, different views of a fireplace system 400 in accordance with various embodiments of the present disclosure are illustrated. Fireplace system 400 comprises many of the components of fireplace system 100 illustrated and described with reference to the schematic diagram shown in FIG. 1. Fireplace system 400 comprises a firebox 401 defined in part by a firebox shell. Fireplace system 400 further defines a firebox opening 402 to permit visibility of the fire or fire feature. Fireplace system 400 comprises a firebox opening 402 on a single side of firebox 401. Firebox 401 and firebox opening 402 may be configured in any of a variety of possible sizes, for example, about 40 inches (about 102 cm) wide and about 15 inches (about 38 cm) high. Firebox opening 402 is enclosed by a first safety barrier 403, and a second safety barrier 404 is disposed in front of and spaced away from the first safety barrier. In various embodiments, first safety barrier 403 can comprise ceramic glass, such as a 5 mm thick ceramic glass pane coupled to the front of firebox 401. Second safety barrier 404 can comprise a glass pane as well, such as a 5 mm thick tempered glass pane. The spacing between the safety barriers defines an interbarrier offset distance, such as a distance of about 75 mm, with the safety barriers partially enclosing interbarrier space 406. As illustrated, fireplace system 400 further includes a third safety barrier 460 disposed within interbarrier space 406 between the first and second safety barrier. Third safety barrier 460 can comprise an additional glass pane, such as another 5 mm tempered glass pane similar to second safety barrier 404. Third safety barrier 460 can be located about midway between first safety barrier 403 and second safety barrier 404 (i.e., approximately 37.5 mm from the front surface of first safety barrier 403). In various embodiments, a third safety barrier may be located at other positions in the interbarrier space, provided there is a space between the surface of the third safety barrier and the adjacent first or second safety barrier.

An upper surface of lower fireplace surround 408 defines a lower boundary of interbarrier space 406. Fireplace system 400 may further comprise various fireplace system components beneath fireplace surround 408 and the lower shell wall of firebox 401. Such components can include, for example, structural support for the fireplace system, combustion air supply channels, gas supply line, regulators, burner components, and the like. An aperture between a lower edge of second safety barrier 404 and lower fireplace surround 408 defines interbarrier space inlet 407 and permits fluid communication between ambient or room air outside of fireplace system 400 and interbarrier space 406. A fireplace system such as system 400 may also comprise a space between the lateral edges of second safety barrier 404 and lateral panels of system 400 defining the right and left sides of firebox opening 402. While not wishing to be bound by theory, providing a space between the lateral edges of second safety barrier 404 and the lateral panels may reduce thermal conductance from the lateral panels to second safety barrier 404 and may permit additional airflow between ambient air in the room and interbarrier space 406.

In accordance with various embodiments, fireplace system 400 further defines interbarrier space outlet 409 at the upper portion of interbarrier space 406. Interbarrier space outlet 409 can provide fluid communication between interbarrier space 406 and other portions of fireplace system 400, such as firebox top heat exchanger 411 and a cavity or enclosed chase. Fireplace system 400 can comprise firebox top heat exchanger 411 further comprising cowl 419 located adjacent to interbarrier space outlet 409 and configured to direct airflow exiting from interbarrier space 406 into heat exchanger 411. As shown in FIG. 4, cowl 419 may be disposed in outlet 409 in a position suitable to permit a portion of the airflow past cowl 419, for example, into an cavity or enclosed chase above system 400, while a portion of the airflow is directed into firebox top heat exchanger 411 via heat exchanger inlet 414. In various embodiments and as illustrated, cowl 419 need not extend the full length of the fireplace opening. Instead, cowl 419 may be centrally located in front of the hottest part of the firebox, for example, with a length and position corresponding approximately to that of a burner or fire feature. Moreover, a cowl may not extend to meet or contact the top of the second barrier glass (or third barrier glass), as physical contact between the cowl and the barrier glass can cause undesirable results in barrier glass temperature tests, possibly due to conduction of thermal energy from the cowl to the glass.

Firebox top heat exchanger 411 is configured to enclose a first volume of air 412. Firebox top heat exchanger 411 can further comprise one or more heat exchanger outlets 417. Airflow in heat exchanger 411 can pass through the heat exchanger and exit the heat exchanger through heat exchanger outlets 417. Heat exchanger outlets 417 may be located toward the rear of the heat exchanger and away from the portion of the heat exchanger that experiences the highest temperatures during fireplace operation, such as a central area of the heat exchanger, to maximize contact of the incoming air with the heated firebox top. A variety of heat exchanger configurations are possible. For example, a heat exchanger can further comprise features such as a baffle or similar internal structure configured to direct incoming air within the heat exchanger in a manner suitable to further direct or extend the airflow path and/or surface area within the heat exchanger, thereby increasing thermal energy transfer from the firebox and heat exchanger to the first volume of air 412.

In operation, heat exchanger 411 and various aspects of its configuration, such as the cowl opening configuration, heat exchanger outlet configuration, and the convection airflow pathway through the heat exchanger can reduce the build-up of heat in the firebox. This can in turn produce benefits such as reduced temperatures for various components of the fireplace system as well as the cavity above and building structure around the fireplace system. For example, the various features of fireplace system 400 may provide reduced temperatures for front panel 471 of the fireplace system and/or an adjacent header in the surrounding building structure, enabling the use of combustible structural and finishing material. This has the advantage of providing more finishing options for the interior designer/homeowner, which is a desirable advantage in the market.

In various embodiments, heat exchanger outlets 417 may vent air from heat exchanger 411 into a cavity or chase enclosure above fireplace system 400, or a fireplace system can further comprise an outlet duct in fluid communication with heat exchanger 411 via heat exchanger outlet 417. In various embodiments and as described above with reference to FIG. 3, an outlet duct may be attached to heat exchanger 411 at outlet 417 and configured to channel heated air to a remote outlet by natural convection forces produced by thermal energy transfer from the firebox to air in the interbarrier space 406 and heat exchanger 411.

With reference now to FIGS. 5A-5I, a three sided fireplace system 500 in accordance with various embodiments is illustrated. Fireplace system 500 comprises various features described above with respect to fireplace systems 100 and 400 illustrated in FIGS. 1 and 4A-4G, respectively. Firebox 501 comprises a firebox opening 502 providing visibility to the interior of the firebox from the front and from each side of the firebox. Fireplace system 500 comprises a first safety barrier 503 enclosing the three sides of firebox 501 defining firebox opening 502, and further comprises a second safety barrier 504 disposed in front of the first safety barrier on the same three sides. Interbarrier space 506 is partially defined between first safety barrier 503 and second safety barrier 504 around the three sides of fireplace system 500 enclosed by glass safety barrier, with the interbarrier space 506 comprising a single continuous space around all three sides of firebox 501, though other non-continuous interbarrier space configurations are possible.

Fireplace system 500 further comprises a third safety barrier 560 disposed in the portion of interbarrier space 506 in front of fireplace system 500. In various embodiments, a third safety barrier such as barrier 560 may be selectively configured in a multi-sided fireplace system in a manner suitable to provide reduced temperatures for portions of the second (outer) safety barrier that may experience higher temperatures than other portions due to the configuration relative to the burner of the fireplace system. For example, the front-facing portions of safety barriers 504 running parallel to the length of the burner and firebox may experience higher temperatures than those located on either side of the firebox, and in various embodiments, a third safety barrier such as barrier 560 may be provided to maintain the front surface of safety barrier 504 below a maximum operating temperature. A third safety barrier may not be required at either end to maintain the surfaces of safety barrier 504 at either end of fireplace system 500 below the maximum operating temperature. However, in various embodiments, a third safety barrier may also be provided in the interbarrier space on either or both sides of a fireplace system to achieve a desired maximum operating temperature of the outer safety barrier at each side of a fireplace system such as system 500.

Fireplace system 500 may further comprise a cowl 519. Cowl 519 may be configured similarly to cowl 419 of fireplace system 400 (FIGS. 4A and 4E), with cowl 519 located on the front of heat exchanger 511 and with the position of cowl 519 corresponding generally to the central portion of the burner and the hottest portion of firebox 501 during operation of fireplace system 500. In various embodiments, fireplace system 500 need not comprise a cowl 519 and associated heat exchanger inlet on the sides of heat exchanger 511 and fireplace system 500 for reasons similar to those described above with respect to the configuration of third safety barrier 560, with the temperatures of the sides of firebox 501 during operation remaining within safe operating parameters without a need for a cowl and heat exchanger inlet located on the sides of firebox 501. However, in various embodiments, a fireplace system may have any suitable configuration of cowl(s) and heat exchanger inlet(s) to achieve desired convection air flow through the fireplace system.

Figure 5A:
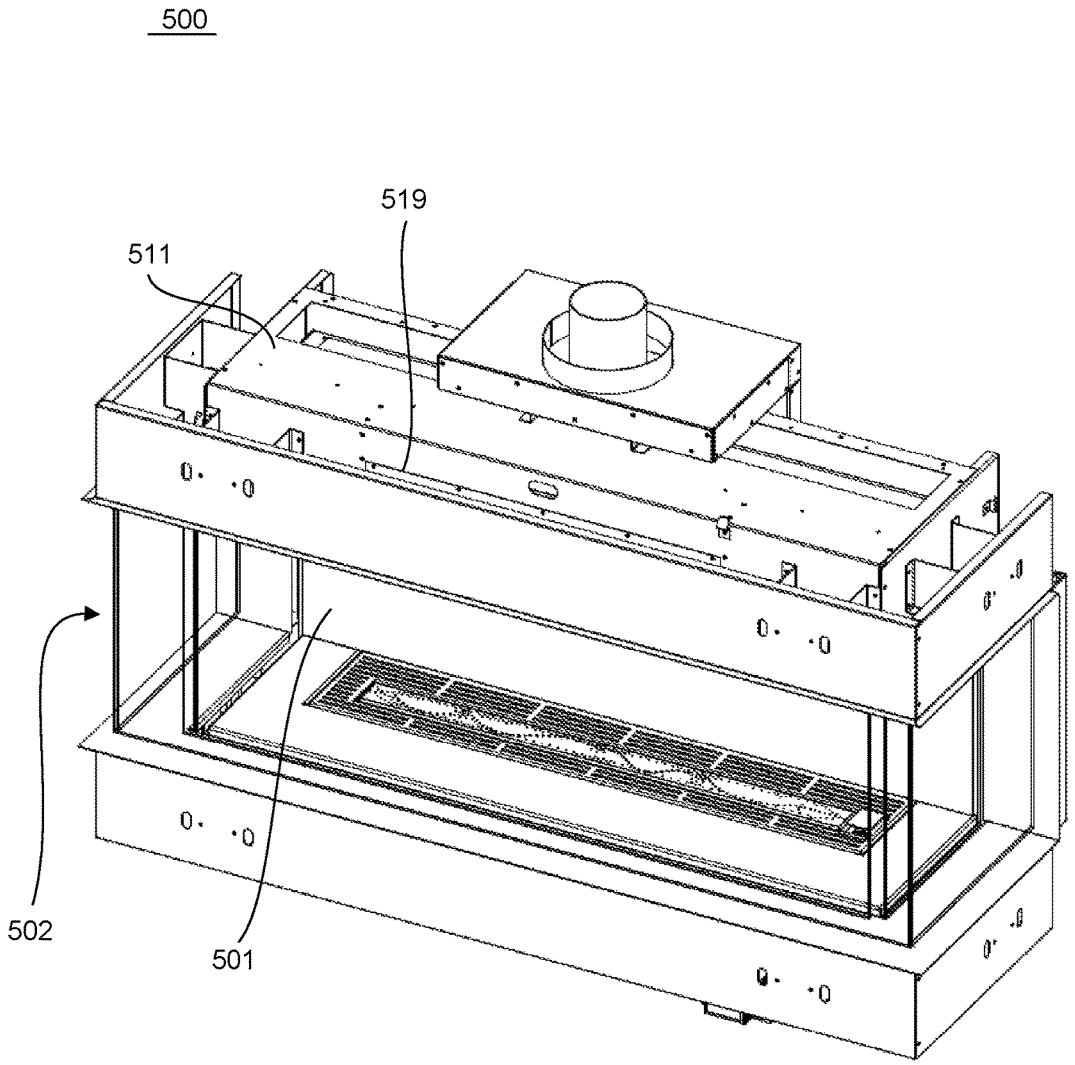
FIG. 5A illustrates a perspective view of a fireplace system in accordance with various embodiments of the present disclosure.
Figure 5B:
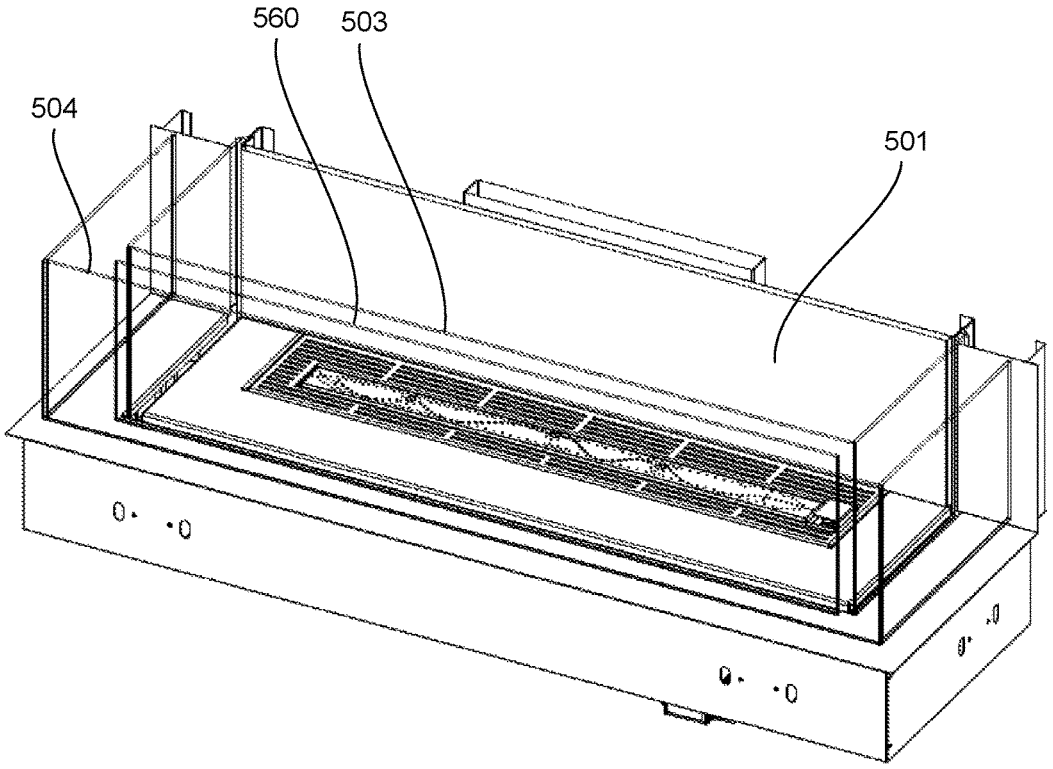
FIG. 5B illustrates a cutaway perspective view of a fireplace system in accordance with various embodiments of the present disclosure.
Figure 5C:
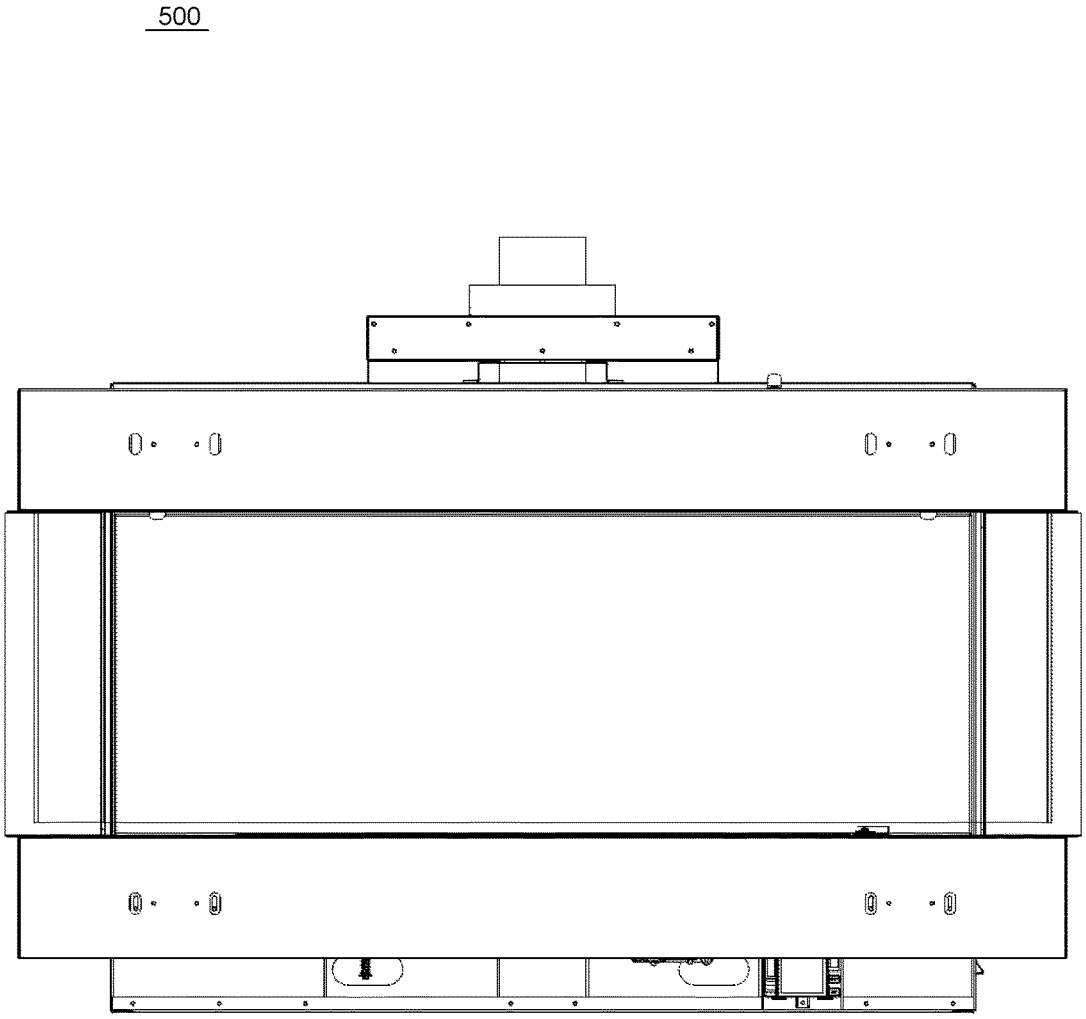
FIG. 5C illustrates a front view of a fireplace system in accordance with various embodiments of the present disclosure.
Figure 5D:
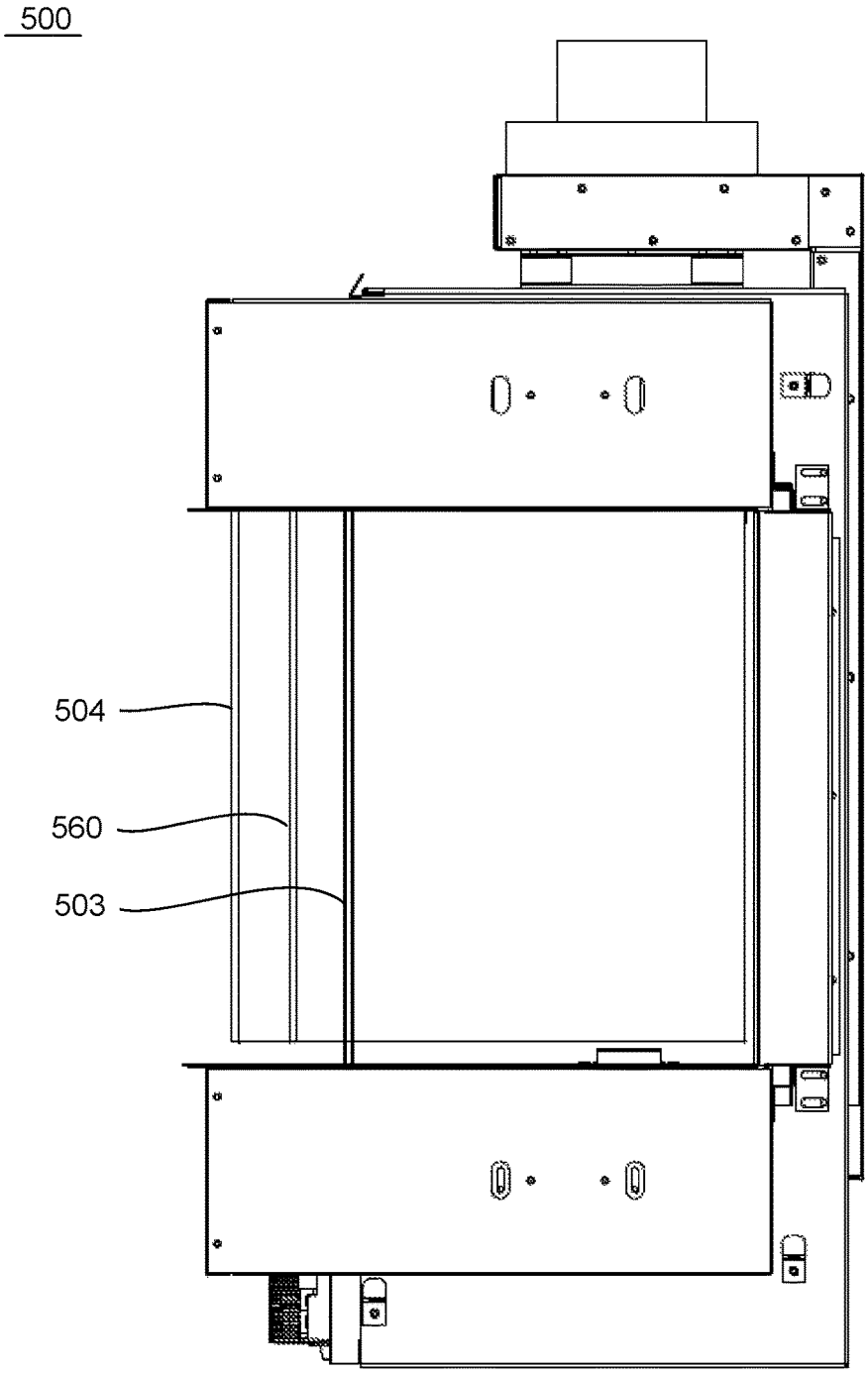
FIG. 5D illustrates a side view of a fireplace system in accordance with various embodiments of the present disclosure.
Figure 5E:
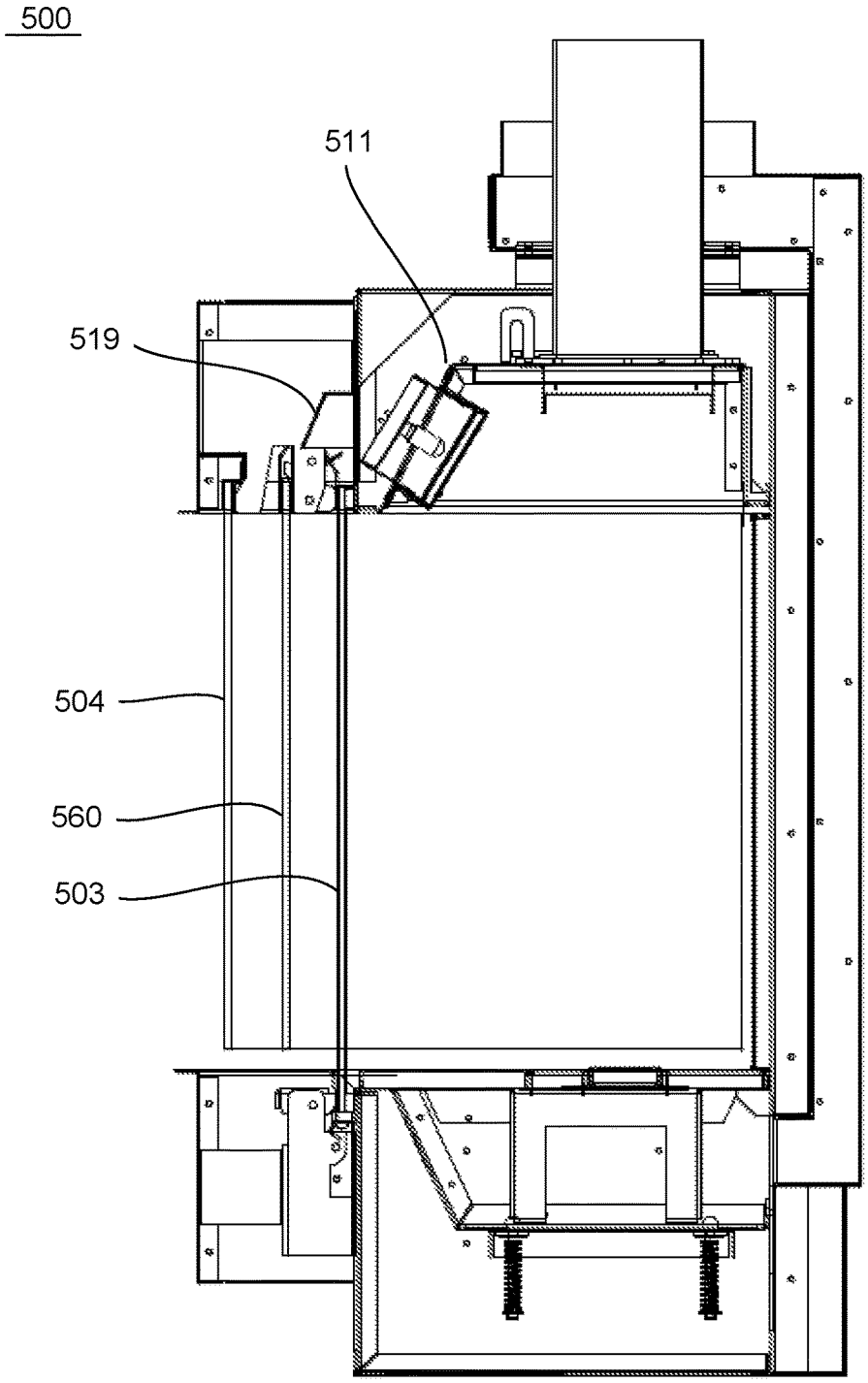
FIG. 5E illustrates a cutaway side view of a fireplace system in accordance with various embodiments of the present disclosure.
Figure 5F:
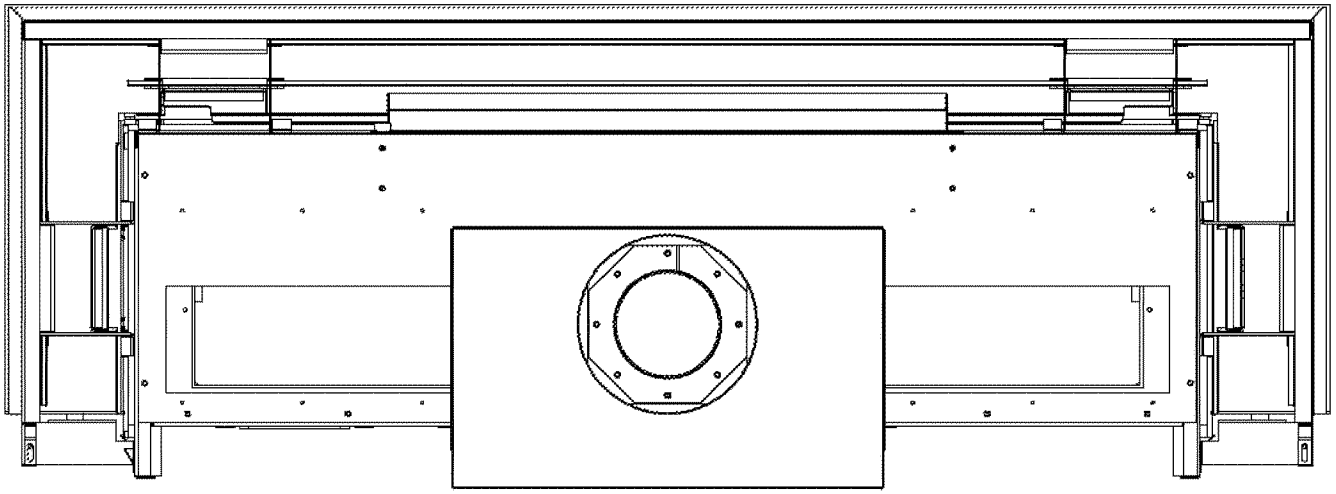
FIG. 5F illustrates a top view of a fireplace system in accordance with various embodiments of the present disclosure.
Figure 5G:
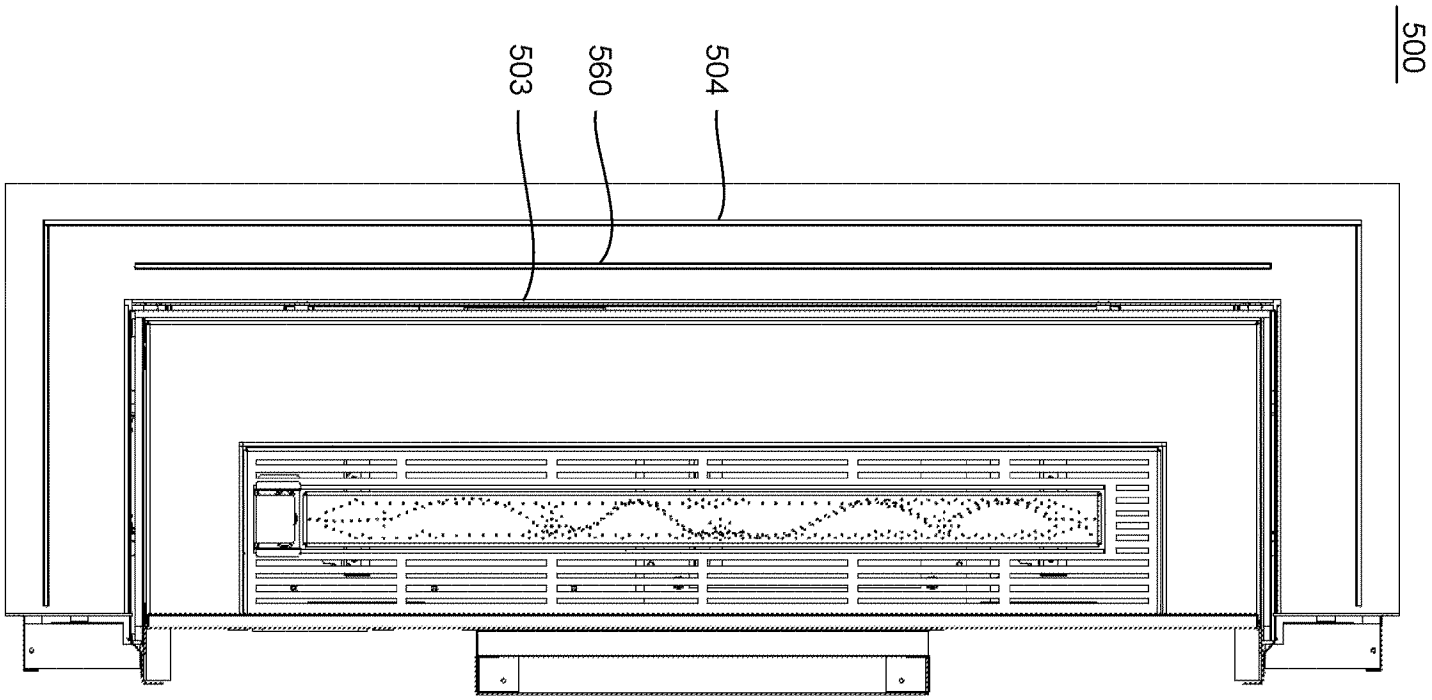
FIG. 5G illustrates a cutaway top view of a fireplace system in accordance with various embodiments of the present disclosure.
Figure 5H:
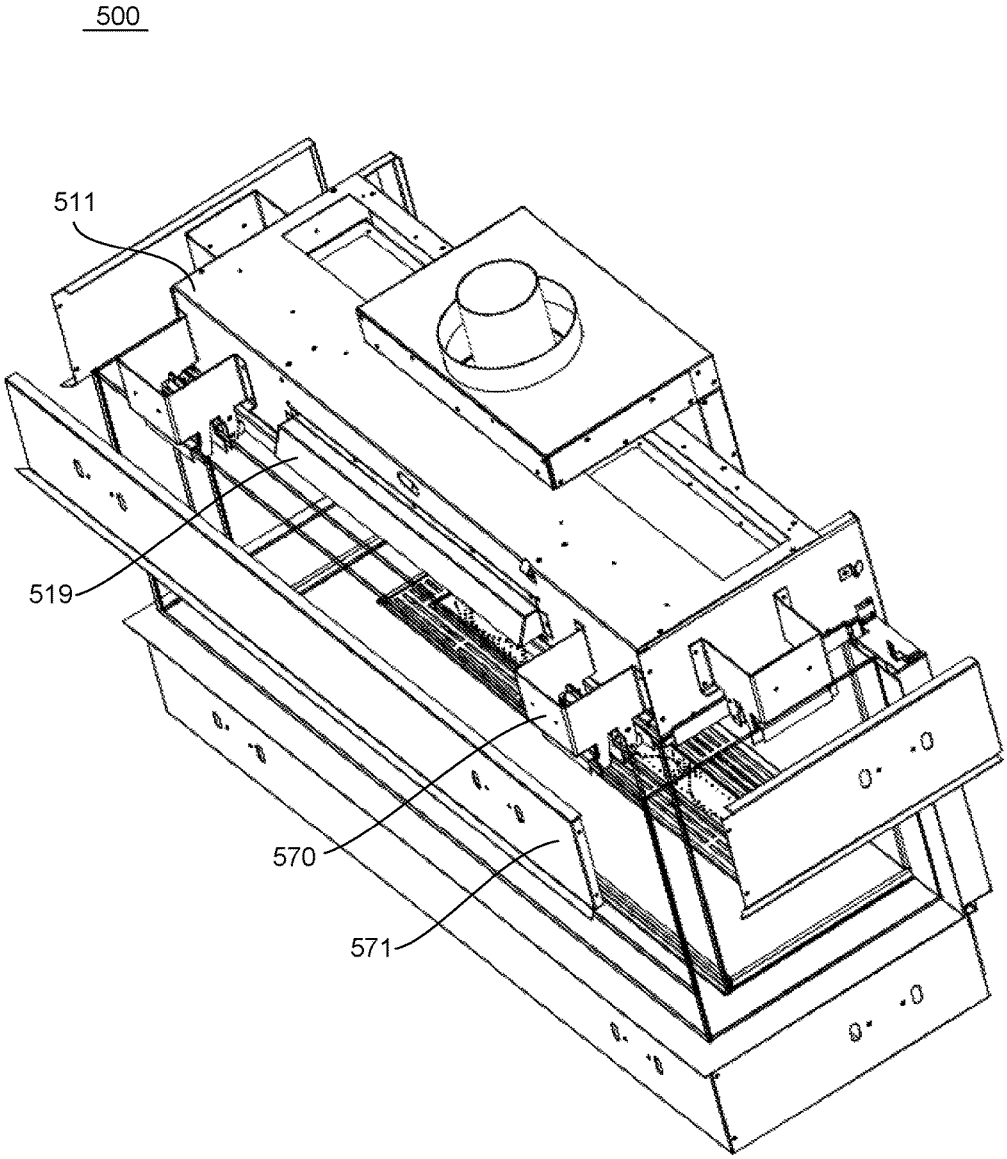
FIG. 5H illustrates a partially-exploded perspective view of a fireplace system in accordance with various embodiments of the present disclosure.
Figure 5I:
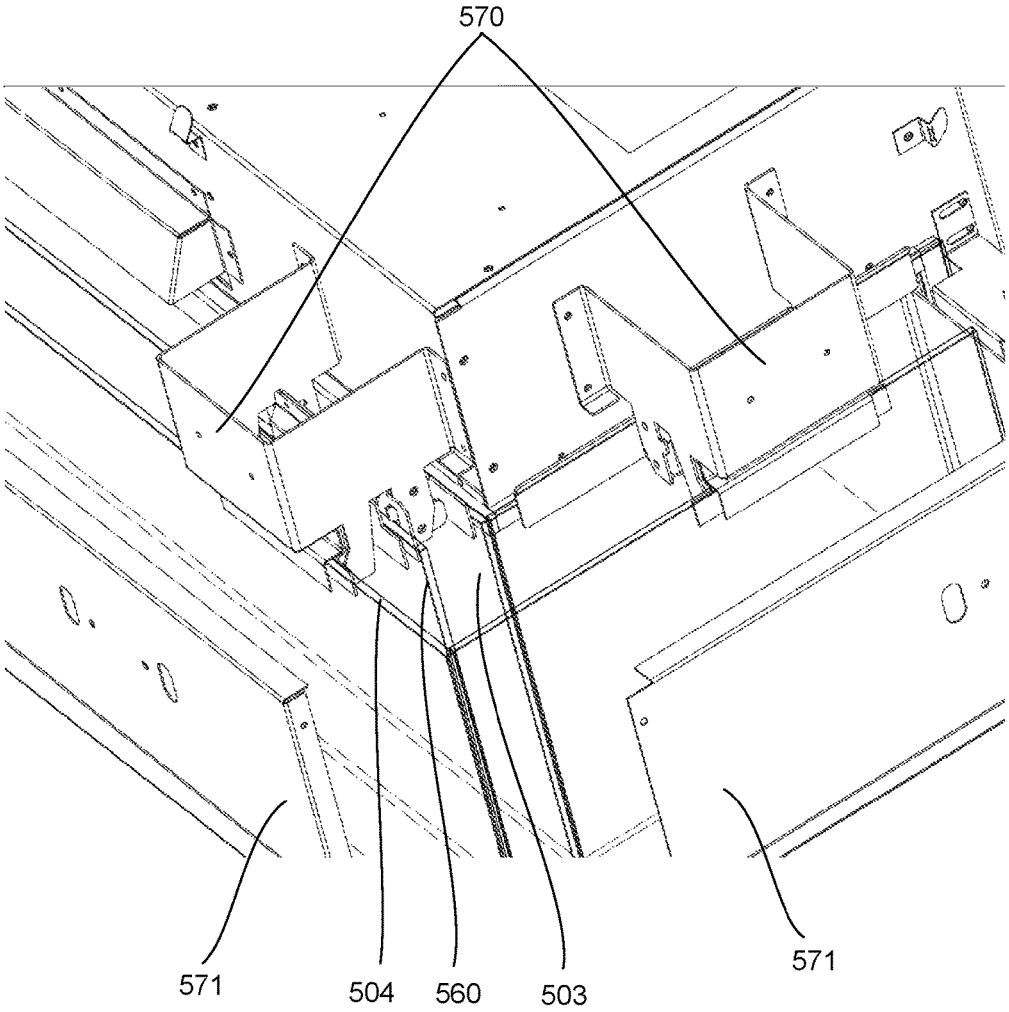
FIG. 5I illustrates a detail view of a portion of a fireplace system in accordance with various embodiments of the present disclosure.

With reference now to FIGS. 5H and 5I, partially exploded and detail views of fireplace system 500 are provided showing safety barrier brackets 570. Brackets 570 may attach to an upper portion of fireplace system 500, such as heat exchanger 511, and be configured to securely support one or more glass safety barriers in front of the fireplace opening. As described above, brackets 570 may be concealed from view within the upper structure of the fireplace system, such as behind upper panels 571 (shown as spaced from bracket) and/or the finished building structure or fixtures of the installed fireplace. In this manner, a fireplace system in accordance with various embodiments can provide the safety features and convection cooling functions described herein while achieve a clean aesthetic and a fireplace opening that does not comprise prominently visible components related to those features and functions.

Figure 6:
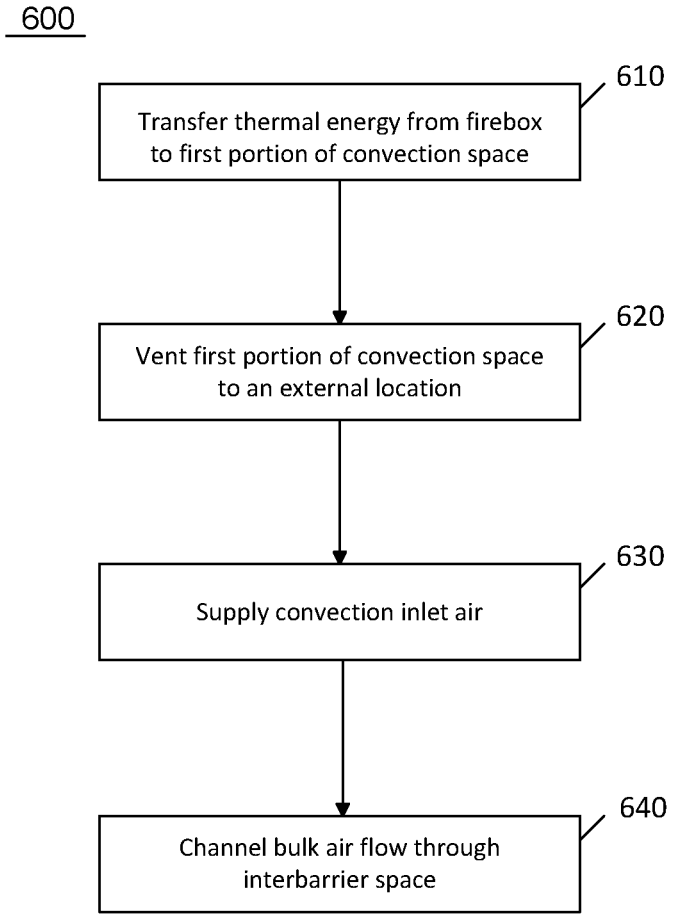
FIG. 6 illustrates a process flow for a method of cooling a fireplace safety barrier in accordance with various embodiments of the present disclosure.

In accordance with various embodiments of the present disclosure, a method of cooling a fireplace safety barrier by natural convection is also provided. Referring now to FIG. 6, a process flow for a method 600 is illustrated. Method 600 comprises transferring thermal energy from a firebox of a fireplace system, such as firebox 101 of fireplace system 100 illustrated in FIG. 1, to a first portion of a convection space air volume (step 610). A convection space air volume can comprise the entire volume of a natural convection cooling system for a fireplace system. For example, the convection air space volume of a fireplace system such as system 100 can include the air volume located in interbarrier space 106 as a portion of the convection space air volume. Similarly, the convection space air volume can also include the air volume located in an optional heat exchanger such as firebox top heat exchanger 111. A portion (i.e., a second portion) of the convection space air volume can also include air located in other portions of the fireplace system convection space, such as portions of the convection space located at distal ends of the system, including, ambient air, such as room air, that is outside of the fireplace system but in fluid communication with the natural convection cooling system of the fireplace system.

In various embodiments, step 610 comprises transferring thermal energy to a first portion of a convection space air volume to produce a decrease in air density of the first portion of the convection space air volume relative to a second portion of the convection space air volume. The relative decrease in air density of the first portion of the convection air space produces an increased air buoyancy of the first portion of the convection space air relative to the second portion of the convection space air volume. The relatively buoyant first portion of the convection space air volume can drive a natural convective airflow through the convection air space, as explained in greater detail below.

In various embodiments, method 600 can further comprise venting the first portion of the convection space air volume to an external location (step 620). Venting the first portion of the convection space air volume having an increased buoyancy produced by thermal energy transfer from the firebox to the first portion of the convection space air volume can produce bulk air flow of the first portion of the convection space air volume toward the external location. Fluid communication of the first portion of the convection space air volume and other portions of the convection space air volume can further result in bulk air flow through the entire convection air space of the fireplace system by the natural convection forces produced by heating the first portion of the convection space air volume. In accordance with various embodiments, bulk air flow through the convection air space of a fireplace system need not be produced using a fan, blower, or other electromechanical means for producing forced convection, though in some embodiments, use of a forced convection system to provide bulk air flow through the convection air space is not prohibited and may contribute to some portion of the bulk air flow during operation of a fireplace system.

Method 600 can further comprise supplying convection inlet air (step 630). In various embodiments, a fireplace system such as fireplace system 100 illustrated in FIG. 1 can comprise a convection inlet such as interbarrier space inlet 107 having a configuration suitable to supply a sufficient flow rate of air to maintain the bulk air flow produced in step 620. In various embodiments, supplying convection inlet air can comprise configuring various properties of a fireplace system with suitable dimensions to maintain a desired air flow rate. Moreover, a desired air flow rate may be dependent on safety considerations relative to the temperature of a second safety barrier, the location of a distal end of an outlet duct, the size and/or heat output of a firebox or a combustion source therein, and the like. Thus, the dimensions or configuration of an inlet aperture, interbarrier offset, or other aspects of a fireplace system convection air space may be changed based on the configuration, operating parameters, and/or location of a fireplace system.

In various embodiments, method 600 can further comprise channeling bulk air flow through an interbarrier space (step 640). As described above, an interbarrier space can be a space defined by a first safety barrier and a second safety barrier, such as such as interbarrier space 106 of fireplace system 100. Bulk air flow through an interbarrier space may comprise air inlet from outside the fireplace system, such as ambient temperature air from the room in which the fireplace system is placed. The air entering the interbarrier space (intake air) may receive thermal energy from the first safety barrier and/or the firebox (such as by conductive and radiant thermal energy transfer). However, the intake air may also receive thermal energy from the second safety barrier and/or serve to cool and/or thermally insulate the second safety barrier, thereby maintaining the second safety barrier at a temperature that is below a maximum operating temperature. In various embodiments, the operating temperature of a second (outer) safety barrier during fireplace operation may be below a maximum operating temperature of about 78° C. (172° F.), while the temperature of first (inner) safety barrier may be about 260° C. (500° F.) during operation of a fireplace system (such as fireplace system 100 (FIG. 1)). Thus, a fireplace system in accordance with various embodiments comprising a natural convection cooling system operating in accordance with method 600 may be able to achieve more than about a 100° C., or more than about a 120° C., or more than about a 140° C., or more than about a 150° C., or more than about a 160° C., or more than about a 170° C., or more than about a 180° C. temperature differential between the second safety barrier and the first safety barrier using only natural convection.

The effectiveness of the cooling system operated in accordance with various embodiments of the present disclosure may be influenced by changes in aspects of a fireplace system configuration. For example, changes in the dimension of an interbarrier offset, an interbarrier space inlet aperture, or a cavity outlet can impact performance of the fireplace system and the effectiveness of the convection cooling effect in reducing the temperature of the outer safety barrier glass. Likewise, addition of a safety barrier in the interbarrier space can also affect a change in temperature of the outer safety barrier. Various configurations of a fireplace system comprising a firebox with a 102 cm (40 inch) wide by 38 cm (15 inch) high fireplace opening on a single side and a 24,000 BTU burner were tested to compare the effects on the temperature of the outer safety barrier at its hottest point (i.e., at the upper portion of the center of the outer safety barrier). An overall temperature differential of 158° C. (317° F.) between the top center portion of the inner safety barrier glass gasket 247° C. (476° F.) and the hottest point of the outer safety barrier 71° C. (159° F.) was achieved during operation of a fireplace system with the configuration described with respect to FIG. 4. In various tests conducted to compare outer safety barrier operating temperatures of otherwise equivalently configured fireplace systems, changes to various configuration parameters were made and the outer safety barrier operating temperatures measured and compared. Changing the interbarrier offset dimension from 58.4 mm (2.3 inches) to 76.2 mm (3 inches) produced an 11° F. decrease in the outer safety barrier operating temperature. Increasing the interbarrier space inlet aperture dimension from 12.7 mm (0.5 inches) to 20.6 mm (0.8125 inches) produced a 16° F. decrease in the outer safety barrier operating temperature. Adding a third safety barrier in the interbarrier space at a position 38.1 mm (1.5 inches) from the front of the inner safety barrier (in a 76.2 mm (3 inch) interbarrier offset) produced a 29° F. decrease in the outer safety barrier operating temperature (notwithstanding a decrease of 6.35 mm (0.25 inch) in the interbarrier space inlet aperture dimension). Similarly, opening a heat exchanger to permit airflow through the heat exchanger produced a 5° F. decrease in the outer safety barrier operating temperature, and increasing a cavity outlet size from 191 $mm^2$ to 305 $mm^2$ produced a 2° F. decrease in the outer safety barrier operating temperature. Other changes, such as directing all airflow from the interbarrier space through a heat exchanger and increasing the thickness of the safety barrier glass from 5 mm to 10 mm produced increases in the outer safety barrier operating temperature. Thus, in various embodiments, a various parameters of a fireplace system may be configured to achieve a desired temperature differential between the hottest portion of the firebox and the hottest portion of the outer safety barrier during operation of the fireplace, thereby providing a fireplace system that can meet applicable safety standards. Optimally, these results can be achieved without the use of an electromechanically operated fan or blower, although nothing in the present disclosure should be interpreted to preclude the use of such components.

The present disclosure sets forth a system and method for providing a fireplace safety barrier that is cooled by natural convection using inconspicuously located inlets and remotely located outlets. It will be understood that the foregoing description is of exemplary embodiments of the disclosure, and that the disclosure is not limited to the specific configurations shown. Various modifications may be made in the design and arrangement of the elements of the systems and methods set forth herein without departing from the scope of the disclosure. For example, the configuration and arrangements of various components of a fireplace system may deviate from those of the exemplary embodiments described and illustrated herein while achieving a similar functional and/or aesthetic purpose. These and other changes or modifications are intended to be included within the scope of the present disclosure.

What is claimed is:

1. A fireplace system comprising:

a firebox;

a firebox opening defined by the fireplace system;

a first safety barrier;

a second safety barrier, wherein the first safety barrier and the second safety barrier are separated by an interbarrier offset dimension and define an interbarrier space between the first safety barrier and the second safety barrier;

an interbarrier space inlet in fluid communication with the interbarrier space;

an interbarrier space outlet in fluid communication with the interbarrier space; and a firebox top heat exchanger comprising a heat exchanger volume defined by an enclosure disposed above the firebox, wherein the heat exchanger volume is in fluid communication with the interbarrier space.

2. The system of claim 1, wherein the firebox top heat exchanger defines a first interbarrier space outlet and a second interbarrier space outlet, and wherein each of the first interbarrier space outlet and the second interbarrier space outlet is in fluid communication with the interbarrier space.

3. The system of claim 2, wherein the firebox top heat exchanger comprises a cowl that defines the first interbarrier space outlet and the second interbarrier space outlet.

4. The system of claim 3, further comprising an outlet duct operatively connected to the firebox top heat exchanger and in fluid communication with the interbarrier space outlet.

5. The system of claim 4, wherein the first interbarrier space outlet is in fluid communication with the outlet duct.

6. The system of claim 5, further comprising a plurality of outlet ducts.

7. The system of claim 1, further comprising a lower firebox opening surround surface.

8. The system of claim 7, wherein the interbarrier space inlet comprises an inlet aperture between a lower edge of the second safety barrier and the lower firebox opening surround surface.

9. The system of claim 7, wherein the interbarrier space inlet comprises a channel located beneath the lower firebox opening surround surface, and wherein the lower firebox opening surround surface comprises penetrations to permit fluid communication between room air, the channel, and the interbarrier space.

10. The system of claim 1, wherein the system does not comprise an inlet located outside of an area defined by boundaries of the firebox opening.

11. The system of claim 1, wherein the system does not comprise a fan or blower operatively connected to the interbarrier space.

12. The system of claim 1, wherein the system does not comprise a metal mesh screen within the firebox opening.

13. The system of claim 1, further comprising a third safety barrier disposed between the first safety barrier and the second safety barrier.

14. The system of claim 1, wherein the first safety barrier fluidly isolates the firebox from air within or proximate the interbarrier space.

15. The system of claim 14, further comprising a firebox exhaust system comprising an exhaust flue that is coaxial with the combustion air inlet, wherein the exhaust flue and the combustion air inlet are in fluid communication with the firebox.

* * * * *